US010343400B2

(12) United States Patent
Sugai

(10) Patent No.: US 10,343,400 B2
(45) Date of Patent: Jul. 9, 2019

(54) LIQUID DISCHARGE APPARATUS AND METHOD FOR CONTROLLING THE SAME

(71) Applicant: Seiko Epson Corporation, Tokyo (JP)

(72) Inventor: Keigo Sugai, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/916,714

(22) Filed: Mar. 9, 2018

(65) Prior Publication Data

US 2018/0281410 A1 Oct. 4, 2018

(30) Foreign Application Priority Data

Mar. 28, 2017 (JP) ..... 2017-062701
Dec. 28, 2017 (JP) ..... 2017-253336

(51) Int. Cl.
*B41J 2/14* (2006.01)
*B41J 2/16* (2006.01)

(52) U.S. Cl.
CPC ..... *B41J 2/14274* (2013.01); *B41J 2/14233* (2013.01); *B41J 2/1607* (2013.01); *B41J 2202/05* (2013.01); *B41J 2202/10* (2013.01); *B41J 2202/12* (2013.01)

(58) Field of Classification Search
CPC ... B41J 2/14274; B41J 2/14233; B41J 2/1607
USPC ..... 347/20, 54, 68, 70–72
See application file for complete search history.

(56) References Cited

U.S. PATENT DOCUMENTS

2008/0018715 A1 1/2008 Wee et al.
2011/0169897 A1 7/2011 Yokoyama et al.
2011/0228012 A1 9/2011 Yoshida et al.
2011/0234706 A1 9/2011 Yoshida et al.

FOREIGN PATENT DOCUMENTS

EP 1 862 311 A1 12/2007
JP 2001-063047 A 3/2001
JP 2011-213094 A 10/2011
JP 2011-224971 A 11/2011
WO WO-2013-032471 A1 3/2013

OTHER PUBLICATIONS

Extended European Search Report for Patent Application No. EP18162127.7, dated Jul. 30, 2018 (14 pages).

*Primary Examiner* — An H Do
(74) *Attorney, Agent, or Firm* — Harness, Dickey & Pierce, P.L.C.

(57) ABSTRACT

There is provided a liquid discharge apparatus including: a liquid-chamber that communicates with a nozzle and a flow-chapel; a liquid chamber driving unit that changes a volume of the liquid-chamber; and a valve that changes a volume of the flow-channel. At least one of first control of increasing the volume of the liquid-chamber, such that a change amount of the volume of the liquid-chamber is equal to or larger than a volume of the liquid flowing from the flow-channel into the liquid-chamber due to the decrease in volume of the flow-channel by the valve, and second control of decreasing the volume of the liquid-chamber, such that a change amount of the volume of the liquid-chamber is equal to or larger than a volume of the liquid flowing from the liquid-chamber out to the flow-channel due to the increase in volume of the flow-channel by the valve, is executed.

8 Claims, 24 Drawing Sheets

LIQUID DISCHARGE APPARATUS AND METHOD FOR CONTROLLING THE SAME

BACKGROUND

1. Technical Field

The present invention relates to a liquid discharge apparatus and a method for controlling the liquid discharge apparatus.

2. Related Art

In the related art, various types of liquid discharge apparatuses that discharge a liquid in a liquid chamber from nozzles provided in the liquid chamber by changing a volume of the liquid chamber are proposed. Such liquid discharge apparatuses include a liquid discharge apparatus in which an inner wall surface of a liquid flow channel that is connected to a liquid chamber is shifted such that flow-channel resistance thereof is variably controlled (for example, JP-A-2001-63047, JP-A-2011-213094, and the like).

However, the inventors of the invention have found that, in a case where the inner wall surface is shifted in a direction in which a sectional area of the liquid flow channel is decreased in order to increase the flow-channel resistance of the liquid flow channel, there is a possibility that a liquid is likely to be pushed from the liquid flow channel to the liquid chamber and the liquid is likely to leak from nozzles. In addition, the inventors of the invention have found that, in a case where the inner wall surface is shifted in a direction in which the sectional area of the liquid flow channel is increased, there is a possibility that the liquid is likely to flow from the liquid chamber to the liquid flow channel and the external air is likely to be suctioned in from nozzles. Such problems are not limited to the liquid discharge apparatus including both of an inflow channel, through which the liquid is caused to flow into the liquid chamber, and an outflow channel, through which the liquid is caused to flow out from the liquid chamber, but are common to general liquid discharge apparatus that is configured to shift an inner wall surface of a flow channel of a liquid, which is connected to a liquid chamber.

SUMMARY

The invention can be realized in the following aspects.

[1] According to a first aspect of the invention, there is provided a liquid discharge apparatus that discharges a liquid. A liquid discharge apparatus of the aspect includes: a liquid chamber that communicates with a nozzle and contains a liquid; a liquid chamber driving unit that changes a volume of the liquid chamber so as to discharge the liquid from the nozzle; a flow channel which is connected to the liquid chamber and through which the liquid flows; a valve that changes flow-channel resistance of the flow channel so as to control flow of the liquid between the liquid chamber and the flow channel, by shifting an inner wall surface of the flow channel so as to change a volume of the flow channel; and a controller that controls the liquid chamber driving unit and the valve. The controller executes at least one of (i) first control of causing the liquid chamber driving unit to increase the volume of the liquid chamber in association with a decrease in volume of the flow channel by the valve, such that a change amount of the volume of the liquid chamber is equal to or larger than a volume of the liquid flowing from the flow channel into the liquid chamber due to the decrease in volume of the flow channel, and (ii) second control of causing the liquid chamber driving unit to decrease the volume of the liquid chamber in association with an increase in volume of the flow channel by the valve, such that a change amount of the volume of the liquid chamber is equal to or larger than a volume of the liquid flowing from the liquid chamber out to the flow channel due to the increase in volume of the flow channel.

According to the liquid discharge apparatus, in the first control of decreasing the volume of the flow channel in order to increase the flow-channel resistance of the flow channel, the volume of the liquid chamber is increased by at least an amount such that the liquid chamber contains the liquid flowing from the flow channel to the liquid chamber due to the decrease in volume of the flow channel. Hence, flowing-out of the liquid from the nozzle due to the decrease in volume of the flow channel is suppressed. In addition, in the second control of increasing the volume of the flow channel in order to decrease the flow-channel resistance of the flow channel, the volume of the liquid chamber is decreased by at least an amount of volume of the liquid flowing from the liquid chamber out to the flow channel due to the increase in volume of the flow channel. Hence, suction of the external air from the nozzle due to the increase in volume of the flow channel is suppressed.

[2] In the liquid discharge apparatus, the flow channel may include an inflow channel through which the liquid supplied to the liquid chamber flows; the valve may include a supply valve that is provided in the inflow channel and changes a volume of the inflow channel; the first control includes first supply valve control of causing the liquid chamber driving unit to increase the volume of the liquid chamber in association with a decrease in volume of the inflow channel by the supply valve, such that a change amount of the volume of the liquid chamber is equal to or larger than the volume of the liquid flowing from the inflow channel into the liquid chamber due to the decrease in volume of the inflow channel; and the second control includes second supply valve control of causing the liquid chamber driving unit to decrease the volume of the liquid chamber in association with an increase in volume of the inflow channel by the supply valve, such that a change amount of the volume of the liquid chamber is equal to or larger than the volume of the liquid flowing from the liquid chamber out to the inflow channel due to the increase in volume of the inflow channel.

According to the liquid discharge apparatus, in the first supply valve control of decreasing the volume of the inflow channel in order to increase the flow-channel resistance of the inflow channel, the flowing-out of the liquid from the nozzle due to the decrease in volume of the inflow channel is suppressed. In addition, in the second supply valve control of increasing the volume of the inflow channel in order to decrease the flow-channel resistance of the inflow channel, the suction of the external air from the nozzle due to the increase in volume of the inflow channel is suppressed.

[3] In the liquid discharge apparatus, the liquid chamber may include a first liquid chamber communicating with a first nozzle and a second liquid chamber communicating with a second nozzle; the liquid chamber driving unit may include a first liquid chamber driving unit that changes a volume of the first liquid chamber and a second liquid chamber driving unit that changes a volume of the second liquid chamber; the inflow channel may include a first inflow channel connected to the first liquid chamber and a second inflow channel connected to the second liquid chamber; the supply valve may include a first supply valve that changes a volume of the first inflow channel and a second supply valve that changes a volume of the second inflow channel;

the controller may cause, in the first control and the second control, the second liquid chamber driving unit to change the volume of the second liquid chamber while causing the first liquid chamber driving unit to change the volume of the first liquid chamber, in association with the change in volume of the second inflow channel by the second supply valve while causing the first supply valve to change the volume of the first inflow channel; and the first supply valve and the second supply valve may change the volumes of the first inflow channel and the second inflow channel with a drive force generated by a common driving unit.

According to the liquid discharge apparatus, since the first supply valve and the second supply valve use the common driving unit, it is possible to reduce the liquid discharge apparatus in size. In addition, it is possible to easily synchronize operations of the first supply valve and the second supply valve.

[4] In the liquid discharge apparatus, the flow channel may include an inflow channel through which the liquid supplied to the liquid chamber flows and an outflow channel through which the liquid emitted from the liquid chamber flows; the valve may include an emission valve that shifts an inner wall surface of the outflow channel so as to change a volume of the outflow channel; the first control may include first emission valve control of causing the liquid chamber driving unit to increase the volume of the liquid chamber in association with a decrease in volume of the outflow channel by the emission valve, such that a change amount of the volume of the liquid chamber is equal to or larger than the volume of the liquid flowing from the outflow channel into the liquid chamber due to the decrease in volume of the outflow channel; and the second control may include second emission valve control of causing the liquid chamber driving unit to decrease the volume of the liquid chamber in association with an increase in volume of the outflow channel by the emission valve, such that a change amount of the volume of the liquid chamber is equal to or larger than the volume of the liquid flowing from the outflow channel into the liquid chamber due to the increase in volume of the outflow channel.

According to the liquid discharge apparatus, in the first emission valve control of decreasing the volume of the outflow channel in order to increase the flow-channel resistance of the outflow channel, the flowing-out of the liquid from the nozzle due to the decrease in volume of the outflow channel is suppressed. In addition, in the second emission valve control of increasing the volume of the outflow channel in order to decrease the flow-channel resistance of the outflow channel, the suction of the external air from the nozzle due to the increase in volume of the outflow channel is suppressed.

[5] In the liquid discharge apparatus, the liquid chamber may include a first liquid chamber communicating with a first nozzle and a second liquid chamber communicating with a second nozzle; the liquid chamber driving unit may include a first liquid chamber driving unit that changes a volume of the first liquid chamber and a second liquid chamber driving unit that changes a volume of the second liquid chamber; the inflow channel may include a first inflow channel connected to the first liquid chamber and a second inflow channel connected to the second liquid chamber; the outflow channel may include a first outflow channel connected to the first liquid chamber and a second outflow channel connected to the second liquid chamber; the emission valve includes a first emission valve that changes a volume of the first outflow channel and a second emission valve that changes a volume of the second outflow channel; the controller may cause, in the first control and the second control, the second liquid chamber driving unit to change the volume of the second liquid chamber while causing the first liquid chamber driving unit to change the volume of the first liquid chamber, in association with the change in volume of the second outflow channel by the second emission valve while causing the first emission valve to change the volume of the first outflow channel; and the first emission valve and the second emission valve change the volumes of the first outflow channel and the second outflow channel with a drive force generated by a common driving unit.

According to the liquid discharge apparatus, since the first emission valve and the second emission valve use the common driving unit, it is possible to reduce the liquid discharge apparatus in size. In addition, it is possible to easily synchronize operations of the first emission valve and the second emission valve.

[6] In the liquid discharge apparatus, the flow channel may include an inflow channel through which the liquid supplied to the liquid chamber flows and an outflow channel through which the liquid emitted from the liquid chamber flow; the valve may include a supply valve that shifts an inner wall surface of the inflow channel so as to change a volume of the inflow channel and an emission valve that shifts an inner wall surface of the outflow channel so as to change a volume of the outflow channel; the first control may include first valve control of causing the liquid chamber driving unit to increase the volume of the liquid chamber, in association with a decrease in volume of the outflow channel by the emission valve while causing the supply valve to decrease the volume of the inflow channel, such that a change amount of the volume of the liquid chamber is equal to or larger than the volume of the liquid flowing from the inflow channel and the outflow channel into the liquid chamber due to the decrease in both of the volume of the inflow channel and the volume of the outflow channel; and the second control may include second valve control of causing the liquid chamber driving unit to decrease the volume of the liquid chamber in association with an increase in volume of the outflow channel by the emission valve while causing the supply valve to increase the volume of the inflow channel, such that a change amount of the volume of the liquid chamber is equal to or larger than the volume of the liquid flowing from the inflow channel and the outflow channel into the liquid chamber due to the increase in both of the volume of the inflow channel and the volume of the outflow channel.

According to the liquid discharge apparatus, in the first valve control of decreasing the volumes of the inflow channel and the outflow channel in order to increase the flow-channel resistance of the channels, the flowing-out of the liquid from the nozzle is suppressed. In addition, in the second valve control of increasing the volumes of the inflow channel and the outflow channel in order to decrease the flow-channel resistance of the channels, the suction of the external air from the nozzle due to the increase in volumes of the inflow channel and the outflow channel is suppressed.

[7] In the liquid discharge apparatus, the supply valve and the emission valve may change the volume of the outflow channel and the volume of the inflow channel with a drive force generated by a common driving unit.

According to the liquid discharge apparatus, it is possible to reduce the liquid discharge apparatus in size. In addition, it is possible to easily synchronize operations of the supply valve and the emission valve.

[8] The liquid discharge apparatus may further include: a circulation channel for circulating, to the inflow channel, the liquid emitted to the outflow channel.

According to the liquid discharge apparatus, it is possible to suppress remaining of the liquid in the liquid chamber and to suppress degradation of the liquid.

[9] According to a second aspect of the invention, there is provided a method for controlling a liquid discharge apparatus that includes a liquid chamber that communicates with a nozzle and contains a liquid, a liquid chamber driving unit that changes a volume of the liquid chamber so as to discharge the liquid from the nozzle, a flow channel which is connected to the liquid chamber and through which the liquid flows, and a valve that changes flow-channel resistance of the flow channel so as to control flow of the liquid between the liquid chamber and the flow channel, by shifting an inner wall surface of the flow channel so as to change a volume of the flow channel. The method includes: executing at least one of (i) first control of causing the liquid chamber driving unit to increase the volume of the liquid chamber in association with a decrease in volume of the flow channel by the valve, such that a change amount of the volume of the liquid chamber is equal to or larger than a volume of the liquid flowing from the flow channel into the liquid chamber due to a decrease in volume of the flow channel, and (ii) second control of causing the liquid chamber driving unit to decrease the volume of the liquid chamber in association with an increase in volume of the flow channel by the valve, such that a change amount of the volume of the liquid chamber is equal to or larger than a volume of the liquid flowing from the liquid chamber out to the flow channel due to the increase in volume of the flow channel.

According to the method for controlling a liquid discharge apparatus, in the first control of decreasing the volume of the flow channel in order to increase the flow-channel resistance of the flow channel, the flowing-out of the liquid from the nozzle due to the decrease in volume of the inflow channel is suppressed. In addition, in the second control of increasing the volume of the inflow channel in order to decrease the flow-channel resistance of the inflow channel, the suction of the external air from the nozzle due to the increase in volume of the inflow channel is suppressed.

A plurality of constituent elements included examples in the invention described above are not all required and, in order to solve some or all of the problems described above or in order to achieve some or all of the effects described in the specification, it is possible to appropriately perform modification, removal, or replacement with another new element, of some of the plurality of constituent elements, or to partially remove specific details. In addition, in order to solve some or all of the problems described above or in order to achieve some or all of the effects described in the specification, it is possible to combine some or all of technical features included in an example of the invention described above and some or all of technical features included in another example of the invention described above such that another independent example of the invention can be established.

The invention can be realized as various examples in addition to the liquid discharge apparatus and the method for controlling the liquid discharge apparatus. For example, the invention can be realized as an example of a liquid discharge system, a head included in a liquid discharge apparatus, a method for controlling the liquid discharge system or the head, a computer program for executing the method for controlling a liquid discharge apparatus, a non-transitory recording medium in which the computer program is recorded, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
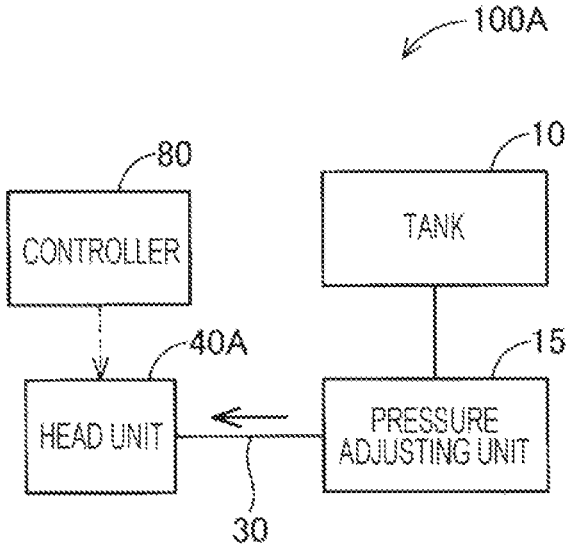
FIG. 1 is a schematic block diagram illustrating a configuration of a liquid discharge apparatus in a first embodiment.

FIG. 1 is a schematic block diagram illustrating an entire configuration of a liquid discharge apparatus 100A in a first embodiment. The liquid discharge apparatus 100A includes a tank 10, a pressure adjusting unit 15, a supply channel 30, a head unit 40A, and a controller 80.

The tank 10 contains a liquid. For example, as the liquid, ink having predetermined viscosity is contained. The liquid in the tank 10 is supplied to the head unit 40A through the supply channel 30 that is connected to the head unit 40A.

The pressure adjusting unit 15 is provided on the supply channel 30. The pressure adjusting unit 15 adjusts pressure of the liquid that is supplied to the head unit 40A to predetermined pressure. The head unit 40A is configured to include a pump that suctions a liquid from the tank 10, a valve that is opened and closed such that pressure on the side of the head unit 40A becomes the predetermined pressure, or the like (not illustrated). The liquid supplied to the head unit 40A is discharged by the head unit 40A. An operation of the head unit 40A is controlled by the controller 80. A configuration of the head unit 40A will be described below.

The controller 80 is configured as a computer including a CPU and a memory and executes a control program stored in the memory, thereby realizing various types of functions for controlling the liquid discharge apparatus 100A. The control program may be recorded in various types of tangible non-transitory recording media.

Figure 2:
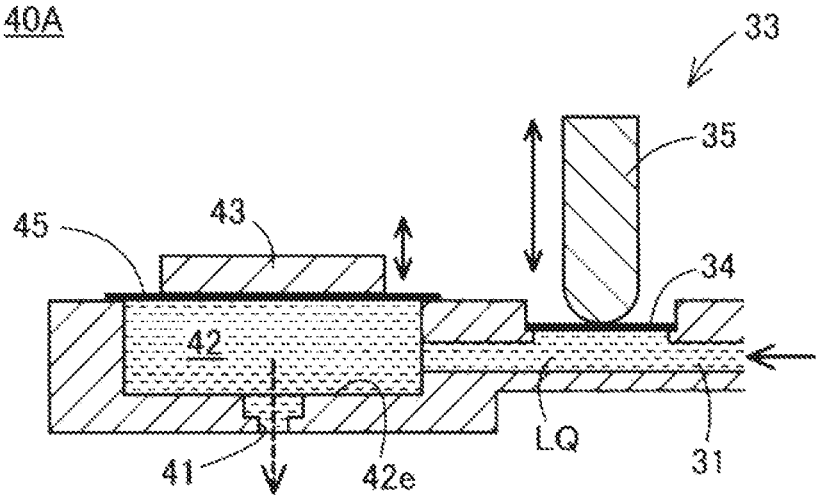
FIG. 2 is a schematic sectional view illustrating an internal configuration of a head unit in the first embodiment.

FIG. 2 is a schematic sectional view illustrating an internal configuration of the head unit 40A. FIG. 2 schematically illustrates the configuration of the head unit 40A on a section plane through both of the central axis of the nozzle 41 and an inflow channel 31. The head unit 40A includes the nozzle 41 that discharges a liquid LQ and a liquid chamber 42 that communicates with the nozzle 41.

The liquid chamber 42 is a chamber to which the liquid LQ is supplied. The liquid chamber 42 is configured as an internal space of a metal housing. The nozzle 41 is provided as a through-hole that is opened in a bottom surface 42*e* of the liquid chamber 42. In the embodiment, the nozzle 41 is opened in the direction of gravitational force. The head unit 40A may include two or more nozzles 41 and two or more liquid chambers 42.

The liquid chamber 42 is provided with a liquid chamber driving unit 43. The liquid chamber driving unit 43 changes the volume of the liquid chamber 42 under control of the controller 80 (FIG. 1) so as to generate a drive force for discharging the liquid LQ from the nozzle 41. A top surface 45 which is the upper surface of the liquid chamber 42 is configured as a vibrating plate (diaphragm) by using a bendable and deformable member such as a metal member having a thin membrane shape or elastic rubber. The liquid chamber driving unit 43 is connected to the top of the top surface 45 and applies an external force to the top surface 45 such that the top surface is bent and deformed, thereby shifting the top surface 45 in a vertical direction so as to change the volume of the liquid chamber 42. In the embodiment, the liquid chamber driving unit 43 is configured of a piezoelectric actuator that is expandable and contractible in the vertical direction. An operation of the liquid chamber driving unit 43 that discharges the liquid LQ from the nozzle 41 will be described below.

The head unit 40A is internally provided with the inflow channel 31 through which the supply channel 30 (FIG. 1) and the liquid chamber 42 are connected to each other and which is a flow channel through which the liquid LQ supplied from the supply channel 30 is caused to flow into the liquid chamber 42. The inflow channel 31 is provided with a supply valve 33. The supply valve 33 changes the volume of the inflow channel 31 under the control of the controller 80 so as to change flow-channel resistance of the inflow channel 31, thereby controlling flow of the liquid LQ between the liquid chamber 42 and the inflow channel 31.

The supply valve 33 includes a flow channel wall member 34 and a driving unit 35. The flow channel wall member 34 configures a part of an inner wall surface of the inflow channel 31. The flow channel wall member 34 is configured of a bendable and deformable member such as a metal thin membrane or elastic rubber. In the embodiment, the flow channel wall member 34 is disposed to be bent and deformed in the vertical direction on the upper surface side of the inflow channel 31. The driving unit 35 is connected to the flow channel wall member 34 and applies, to the flow channel wall member 34, an external force with which the flow channel wall member 34 is bent and deformed, under the control of the controller 80. In the embodiment, the driving unit 35 is configured of a piezoelectric actuator that is expandable and contractible in the vertical direction.

The driving unit 35 is deformed in an expandable and contractible manner so as to cause the supply valve 33 to be bent and deformed. In this manner, a sectional area of the inflow channel 31 is changed in a region in which the supply valve 33 is provided, and the flow-channel resistance of the inflow channel 31 is changed. In the embodiment, the supply valve 33 can cause the flow channel wall member 34 to be bent and deformed until the flow channel wall member 34 comes into contact with the opposite inner wall surface so as to block the inflow channel 31 at a position on the inflow channel. The supply valve 33 may increase or decrease the flow-channel resistance of the inflow channel 31 and may not completely block the inflow channel 31.

Figure 3:
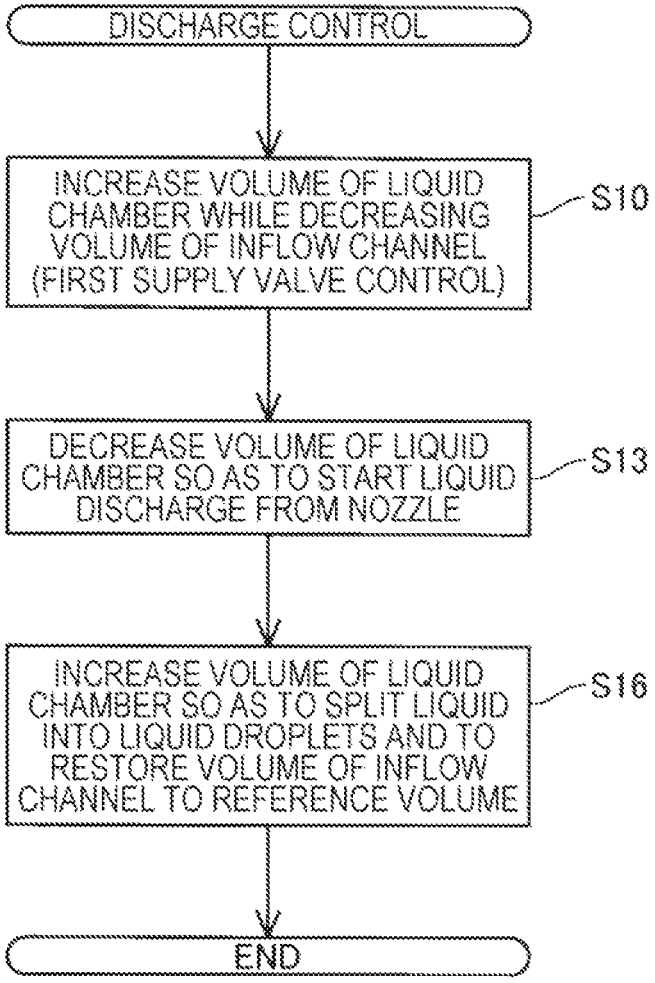
FIG. 3 is a flowchart illustrating flow of discharge control in the first embodiment.
Figure 4A:
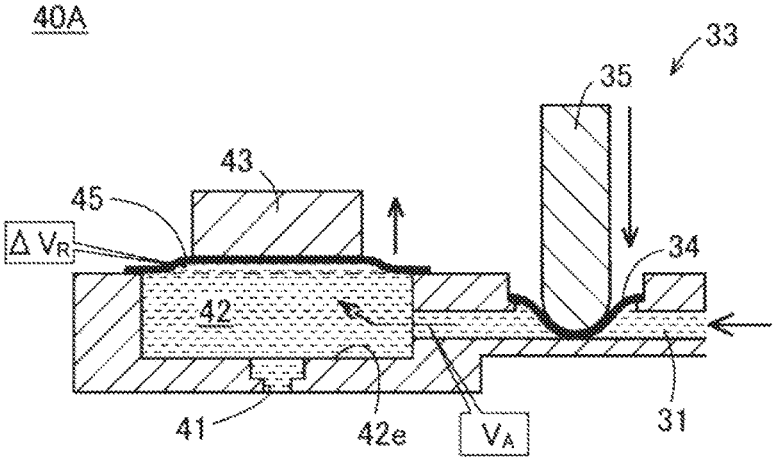
FIG. 4A is a first schematic view illustrating an operation of the head unit in the discharge control.
Figure 4B:
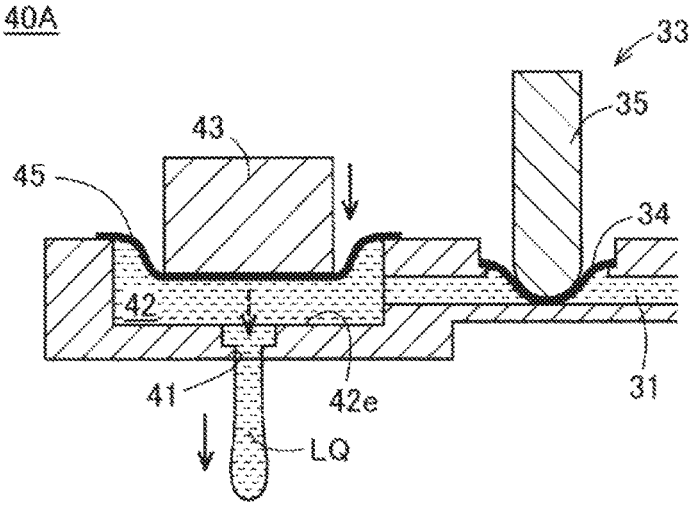
FIG. 4B is a second schematic view illustrating the operation of the head unit in the discharge control.
Figure 4C:
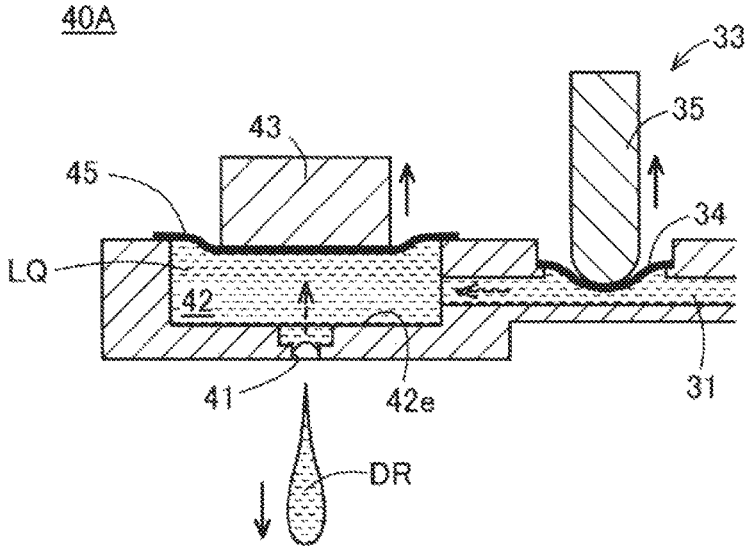
FIG. 4C is a third schematic view illustrating the operation of the head unit in the discharge control.

An example of the discharge control of the head unit 40A, which is executed by the controller 80 (FIG. 1), is described with reference to FIGS. 3, 4A to 4C, and 5. FIG. 3 is a flowchart illustrating flow of the discharge control. FIGS. 4A to 4C are schematic views illustrating an operation of the head unit 40A in control steps in the discharge control.

The controller 80 causes the head unit 40A to come into an initial state before execution of the discharge control. In the initial state, the pressure adjusting unit 15 adjusts the internal pressure of the liquid chamber 42 so as to become predetermined reference pressure that is equal to or lower than meniscus pressure resistance of the nozzle 41. In addition, the controller 80 adjusts the volume of the liquid chamber 42 so as to become a predetermined reference volume and adjusts the volume of the inflow channel 31 so as to become a predetermined reference volume. The reference volume of the liquid chamber 42 may be a volume of the liquid chamber 42 which is obtained when voltage for expansion/contraction motion is not applied to the liquid chamber driving unit 43 and the top surface 45 is not bent and deformed. Similarly, the reference volume of the inflow channel 31 may be a volume of the inflow channel 31 which is obtained when voltage for the expansion/contraction motion is not applied to the driving unit 35 of the supply valve 33 and the flow channel wall member 34 is not bent and deformed. Hereinafter, the flow-channel resistance of the inflow channel 31 obtained when the inflow channel has the reference volume is referred to as "reference resistance".

Step S10 is a step for preparing a start of discharge of the liquid LQ from the nozzle 41. In Step S10, the controller 80 decreases the volume of the inflow channel 31 so as to increase the volume of the liquid chamber 42 from the reference volume while increasing the flow-channel resistance of the inflow channel 31 from the reference resistance (FIG. 4A). In the embodiment, in Step S10, the controller 80 decreases the volume of the inflow channel 31 to a predetermined minimum volume. The minimum volume may be a volume obtained by blocking the inflow channel 31 described above.

Here, a change amount $\Delta V_R$ of the volume of the liquid chamber 42 in an increase direction in Step S10 is equal to or larger than a volume $V_A$ of the liquid LQ flowing from the inflow channel 31 into the liquid chamber 42 by causing the supply valve 33 to change the volume of the inflow channel 31 ($\Delta V_R \geq V_A$). The volume $V_A$ corresponds to an amount of the liquid LQ that is pushed from the inflow channel 31 to the liquid chamber 42 by causing the supply valve 33 to decrease the volume of the inflow channel 31. In addition, the volume $V_A$ corresponds to an amount of the liquid LQ that is suctioned from the liquid chamber 42 into the inflow channel 31 by causing the supply valve 33 to increase the volume of the inflow channel 31. Hereinafter, the volume $V_A$ of the liquid LQ is referred to as a "supply-side movement volume $V_A$". A method of obtaining the supply-side movement volume $V_A$ will be described below.

In Step S10, a buffer space for receiving at least the liquid LQ of the supply-side movement volume $V_A$ is formed in the liquid chamber 42 due to the increase in volume by the change amount $\Delta V_R$ in the liquid chamber 42. Accordingly, leaking of the liquid LQ from the nozzle 41 due to the liquid LQ pushed to the liquid chamber 42 by the operation of the supply valve 33 in a direction, in which the inflow channel 31 is closed, is suppressed.

It is desirable that the change amount $\Delta V_R$ of the volume of the liquid chamber 42 in Step S10 is set in a range in which a state of forming the meniscus in the nozzle 41 is maintained, in order to suppress entering of the external air from the nozzle 41. In addition, the change amount $\Delta V_R$ of the volume of the liquid chamber 42 may be a value obtained by adding, to the supply-side movement volume $V_A$, a volume of the liquid LQ, which corresponds to a discharge amount of the liquid LQ from the nozzle 41 in the following steps.

Step S13 is a step for starting the discharge of the liquid LQ from the nozzle 41. In Step S13, the controller 80 causes the liquid chamber driving unit 43 to rapidly elongate so as to decrease the volume of the liquid chamber 42 (FIG. 4B). In this manner, the liquid LQ is pushed from the liquid chamber 42 and the liquid LQ starts to be ejected from the nozzle 41. At this time, since the flow-channel resistance of the inflow channel 31 is increased in Step S10, a loss of the pressure generated in the liquid chamber 42 in order to discharge the liquid LQ, to the inflow channel 31, is suppressed.

Step S16 is a step for splitting the liquid LQ discharged from the nozzle 41 into liquid droplets DR. In Step S16, the controller 80 contracts the liquid chamber driving unit 43 during the discharge of the liquid LQ from the nozzle 41 so as to increase the volume of the liquid chamber 42, thereby decreasing the pressure of the liquid chamber 42 (FIG. 4C). In this manner, a suction force for suctioning the liquid LQ from the nozzle 41 back to the liquid chamber 42 is generated, and thus the liquid LQ discharged out from the nozzle 41 can be separated from the liquid LQ of the nozzle 41 and can fly as the liquid droplets DR.

In Step S16, the controller 80 causes the supply valve 33 to gradually increase the volume of the inflow channel 31 so as to cause the volume of the inflow channel 31 to return to the reference volume, and the flow-channel resistance of the inflow channel 31 becomes the reference resistance. It is desirable that an increasing rate of the volume of the inflow channel 31 is appropriately adjusted corresponding to an increasing rate of the volume of the liquid chamber 42. It is desirable that the increasing rate of the volume of the inflow channel 31 is adjusted such that the suction force for splitting the liquid into the liquid droplets DR described above is not excessively decreased and is not excessively increased to the extent that the external air is suctioned from the nozzle 41.

Figure 5:
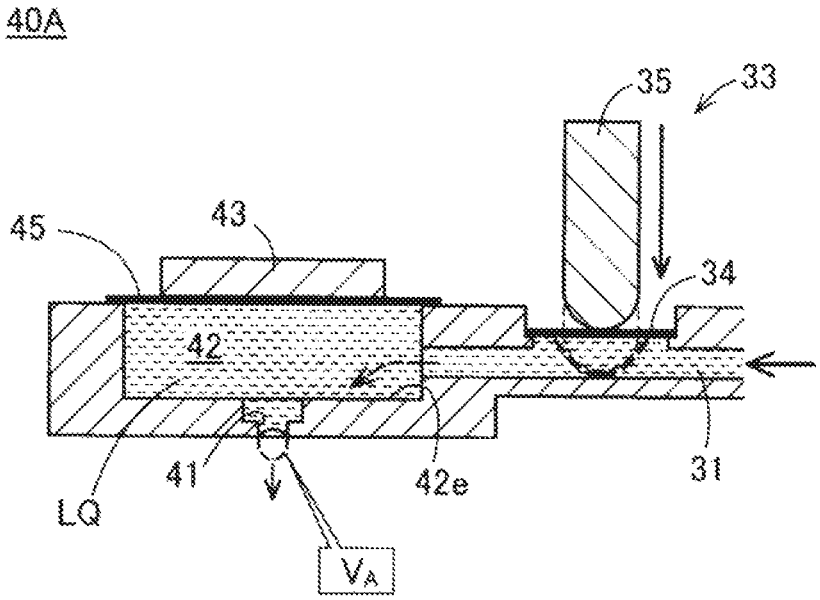
FIG. 5 is a schematic view for illustrating a method of obtaining a supply-side movement volume.

FIG. 5 is a schematic view for illustrating the method of obtaining the supply-side movement volume $V_A$. The supply-side movement volume $V_A$ can be obtained as follow. The inflow channel 31 and the liquid chamber 42 are filled with the liquid LQ and the head unit 40A comes into the initial state described above. At this time, a position of the meniscus in the nozzle 41 is recorded. Without causing the liquid chamber driving unit 43 to change the volume of the liquid chamber 42, the supply valve 33 decreases the volume of the inflow channel 31 to the minimum volume, and an amount of increase of the liquid LQ from the position of the meniscus described above in the initial state is obtained. The amount of increase corresponds to the supply-side movement volume $V_A$. The supply-side movement volume $V_A$ may be obtained as an amount of decrease of the liquid LQ in the liquid chamber 42 and the nozzle 41 when the volume of the inflow channel 31 returns from the minimum volume to the reference volume.

Figure 6:
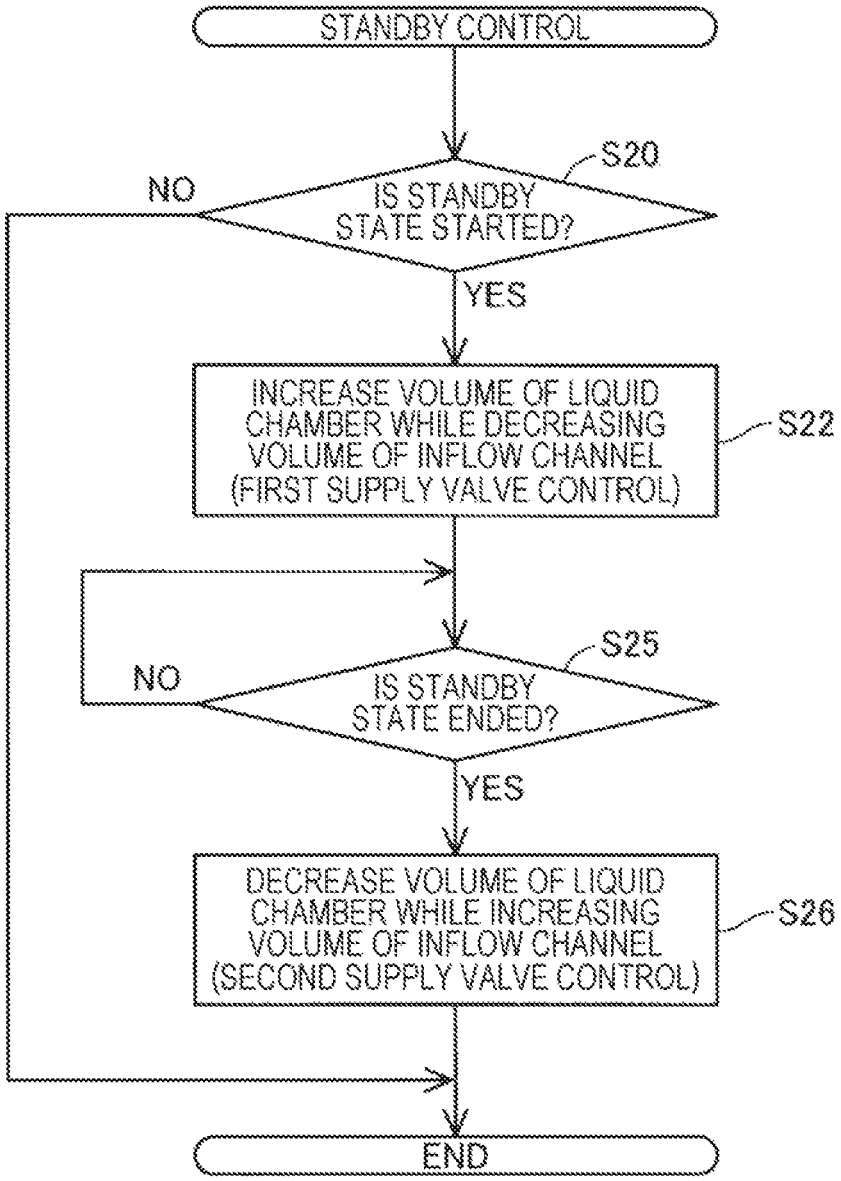
FIG. 6 is a flowchart illustrating flow of standby control in the first embodiment.

An example of standby control of the head unit 40A, which is executed by the controller 80 (FIG. 1), is described with reference to FIG. 6. FIG. 6 is a flowchart illustrating flow of the standby control. In Step S20, the controller 80 determines whether or not the head unit 40A comes into the standby state. In a case where the discharge control of the liquid LQ is not executed for a predetermined period (for example, about several minutes to several hours), the controller 80 determines that the head unit 40A comes into the standby state. The controller 80 may determine to cause the head unit 40A to come into the standby state when an operation of causing the head unit 40A to come into the standby state is received by a user of the liquid discharge apparatus 100A.

When the controller 80 determines to cause the head unit 40A to come into the standby state, the controller executes a process of Step S22. In Step S22, similar to Step S10 (FIGS. 3 and 4A) in the discharge control, the controller 80 causes the liquid chamber driving unit 43 to increase the volume of the liquid chamber 42 such that the head unit 40A comes into the standby state while causing the supply valve 33 to decrease the volume of the inflow channel 31. It is desirable that the change amount $\Delta V_R$ of the volume of the liquid chamber 42 in Step S22 is a value equal to or smaller than the change amount $\Delta V_R$ in Step S10 in the discharge control such that a pressure change does not occur accidentally in the liquid chamber 42. In addition, in Step S22, it is desirable that the inflow channel 31 comes into a substantially blocked state by the supply valve 33.

In Step S22, since the volume of the liquid chamber 42 is increased in association with a valve closing operation of the supply valve 33, leaking of the liquid LQ from the nozzle 41 due to the liquid LQ pushed from the inflow channel 31 is suppressed. In addition, since a state in which flowing of the liquid LQ from the upstream side of the supply valve 33 is suppressed by the supply valve 33 is performed in the standby state, accident leaking of the liquid LQ from the nozzle 41 during the standby state is suppressed.

The controller 80 maintains the standby state until an execution instruction of the discharge control is issued or until a cancel operation of the standby state is received by a user (Step S25). When the standby state is canceled, the controller 80 executes a process of Step S26. In Step S26, the controller 80 causes the liquid chamber driving unit 43 to decrease the volume of the liquid chamber 42 such that the volume of the liquid chamber 42 returns to the reference volume while causing the supply valve 33 to perform a valve opening operation of increasing the volume of the inflow channel 31. Similar to Step S22, the change amount $\Delta V_R$ of the volume of the liquid chamber 42 in Step S26 is a value equal to or larger than the supply-side movement volume $V_A$.

In Step S26, since the volume of the liquid chamber 42 is decreased while the valve opening operation of the supply valve 33 is not performed, the suction of the external air from the nozzle 41 due to the suction force of the liquid LQ to the inflow channel 31, which is generated immediately after the volume of the inflow channel 31 is increased, is suppressed. In Step S26, the supply valve 33 is opened, and thereby the standby control in the liquid discharge apparatus 100A is completed.

Of the control of the head unit 40A by the controller 80, "first supply valve control" means control of increasing the volume of the liquid chamber 42 while decreasing the volume of the inflow channel 31, such that the change amount $\Delta V_R$ of the volume of the liquid chamber 42 is equal to or larger than the supply-side movement volume $V_A$, as described in Steps S10 and S22 (FIGS. 3 and 6). In addition, "second supply valve control" means control of decreasing the volume of the liquid chamber 42 while increasing the volume of the inflow channel 31 such that the change amount $\Delta V_R$ of the volume of the liquid chamber 42 is equal to or larger than the supply-side movement volume $V_A$, as described in Step S26 (FIG. 6).

According to the liquid discharge apparatus 100A of the embodiment, the first supply valve control suppresses the leaking of the liquid LQ from the nozzle 41 due to the valve closing operation of the supply valve 33. In addition, the second supply valve control suppresses the entering of the external air from the nozzle 41 to the liquid chamber 42 due to the valve opening operation of the supply valve 33. Additionally, according to the liquid discharge apparatus 100A and the method for controlling the liquid discharge apparatus of the first embodiment, it is possible to achieve various operational effects as described in the first embodiments.

B. Second Embodiment

Figure 7:
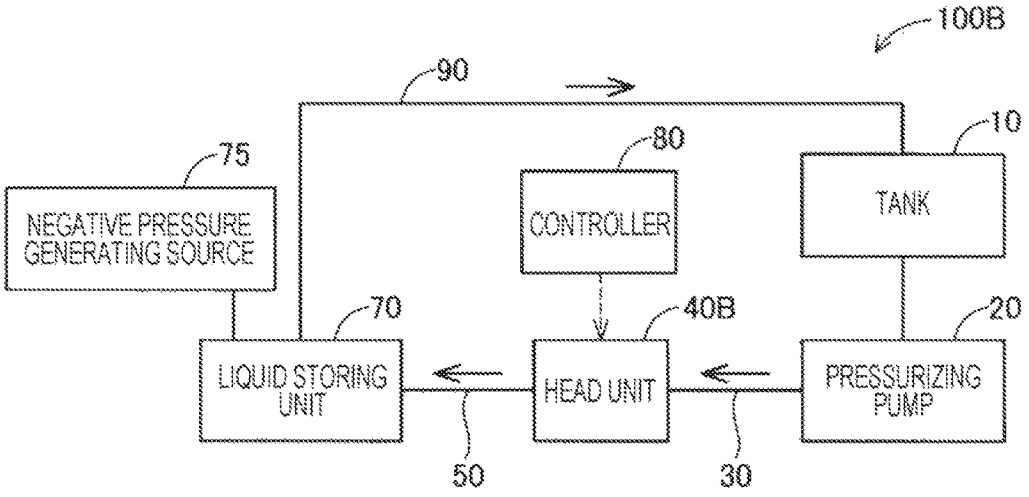
FIG. 7 is a schematic block diagram illustrating a configuration of a liquid discharge apparatus in a second embodiment.

FIG. 7 is a schematic block diagram illustrating an entire configuration of a liquid discharge apparatus 100B in a second embodiment. The liquid discharge apparatus 100B of the second embodiment has substantially the same configuration as that of the liquid discharge apparatus 100A (FIG. 1) of the first embodiment, except for a difference to be described below. The liquid discharge apparatus 100B includes a pressure pump 20, instead of the pressure adjusting unit 15, and includes a head unit 40B, instead of the head unit 40A. In addition, the liquid discharge apparatus 100B further includes an emission channel 50, a liquid storing portion 70, a negative pressure generating source 75, and a circulation channel 90.

The pressure pump 20 supplies the liquid in the tank 10 to the head portion 40B through the supply channel 30. A configuration, an operation, and a method for controlling the head portion 40B of the second embodiment will be described below. The emission channel 50 is connected to head unit 40B and the liquid storing portion 70. A liquid that is not discharged by the head unit 40B is emitted to the liquid storing portion 70 through the emission channel 50. The negative pressure generating source 75 is connected to the liquid storing portion 70. The negative pressure generating source 75 causes the pressure in the liquid storing portion 70 to become the negative pressure, and thereby the liquid is suctioned from the head portion 40B through the emission channel 50. The negative pressure generating source 75 is configured of various types of pumps.

In the liquid discharge apparatus 100B, the pressure pump 20 and the negative pressure generating source 75 function as a liquid supply unit that generates differential pressure between the supply channel 30 and the emission channel 50 so as to supply the liquid to the head unit 40B. The liquid supply unit may be configured as a single member by omitting any one of the pressure pump 20 and the negative pressure generating source 75 and including either of the pressure pump 20 or the negative pressure generating source 75. In the liquid discharge apparatus 100B, since the undischarged liquid is emitted from the head unit 40B, degradation of the liquid due to remaining of the liquid in the head unit 40B, such as a change in concentration of a liquid in association with accumulation of sedimentation components in the liquid or evaporation of the liquid in the head unit 40B, is suppressed.

The circulation channel 90 is connected to the liquid storing portion 70 and the tank 10. The liquid that is emitted from the head unit 40B through the emission channel 50 and is stored in the liquid storing portion 70 returns to the tank 10 through the circulation channel 90 and is resupplied to the head unit 40B by the pressure pump 20. The circulation channel 90 may be provided with a pump for suctioning the liquid from the liquid storing portion 70. The liquid discharge apparatus 100B may employ a configuration in which the circulation channel 90 is omitted and the liquid is not circulated.

Figure 8:
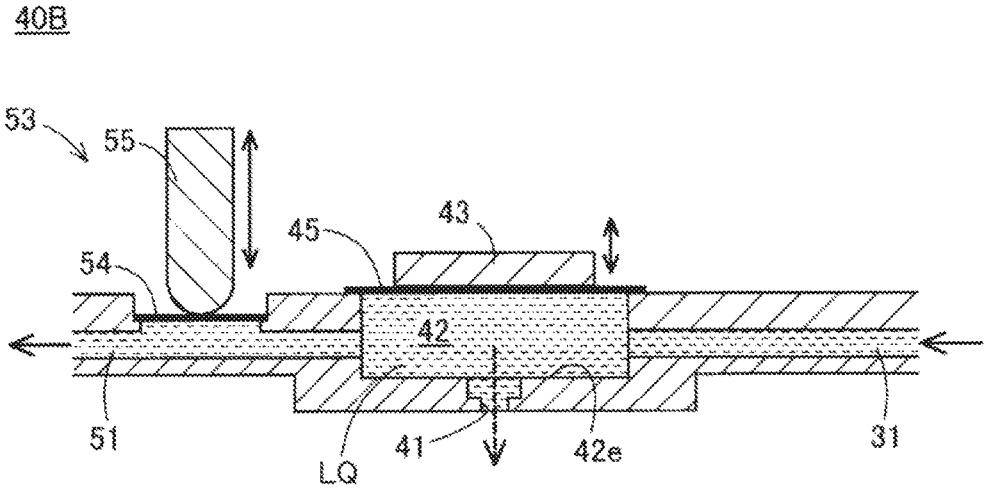
FIG. 8 is a schematic sectional view illustrating an internal configuration of a head unit in the second embodiment.

FIG. 8 is a sectional view illustrating an internal configuration of the head unit 40B. FIG. 8 schematically illustrates the configuration of the head unit 40B on a section plane through the central axis of the nozzle 41 and the inflow channel 31 and an outflow channel 51. The configuration of the head unit 40B of the second embodiment is substantially the same as the configuration of the head unit 40A (FIG. 2) of the first embodiment, except that the supply valve 33 of the inflow channel 31 is omitted and the outflow channel 51 and an emission valve 53 are further provided. Similar to the head unit 40A of the first embodiment, the head unit 40B may include two or more nozzles 41 and two or more liquid chambers 42.

The outflow channel 51 is a flow channel which is connected to the emission channel 50 (FIG. 7) and the liquid chamber 42 and through which the liquid LQ emitted from the liquid chamber 42 flows. The outflow channel 51 is provided inside the head unit 40B. The outflow channel 51 is provided with the emission valve 53. The emission valve 53 changes the volume of the outflow channel 51 under the control of the controller 80 (FIG. 7) so as to change flow-channel resistance of the outflow channel 51, thereby controlling flow of the liquid LQ between the liquid chamber 42 and the outflow channel 51.

The emission valve 53 includes a flow channel wall member 54 and a driving unit 55. The flow channel wall member 54 configures a part of an inner wall surface of the outflow channel 51. The flow channel wall member 54 is configured of a bendable and deformable member such as a metal thin membrane or elastic rubber. The flow channel wall member 54 is disposed to be bent and deformed in the vertical direction on the upper surface side of the outflow channel 51. The driving unit 55 is connected to the flow channel wall member 54 and applies, to the flow channel wall member 54, an external force with which the flow channel wall member 54 is bent and deformed, under the control of the controller 80 (FIG. 7). The driving unit 55 is configured of a piezoelectric actuator that is expandable and contractible in the vertical direction.

The driving unit 55 is deformed in an expandable and contractible manner so as to cause the flow channel wall member 54 to be bent and deformed. In this manner, a sectional area of the outflow channel 51 is changed in a region in which the flow channel wall member 54 is provided, and the flow-channel resistance of the outflow channel 51 is changed. The emission valve 53 can cause the flow channel wall member 54 to be bent and deformed until the flow channel wall member 54 comes into contact with the opposite inner wall surface so as to block the outflow channel 51 at a position on the outflow channel. The emission valve 53 may increase or decrease the flow-channel resistance of the outflow channel 51 and may not completely block the outflow channel 51.

Figure 9:
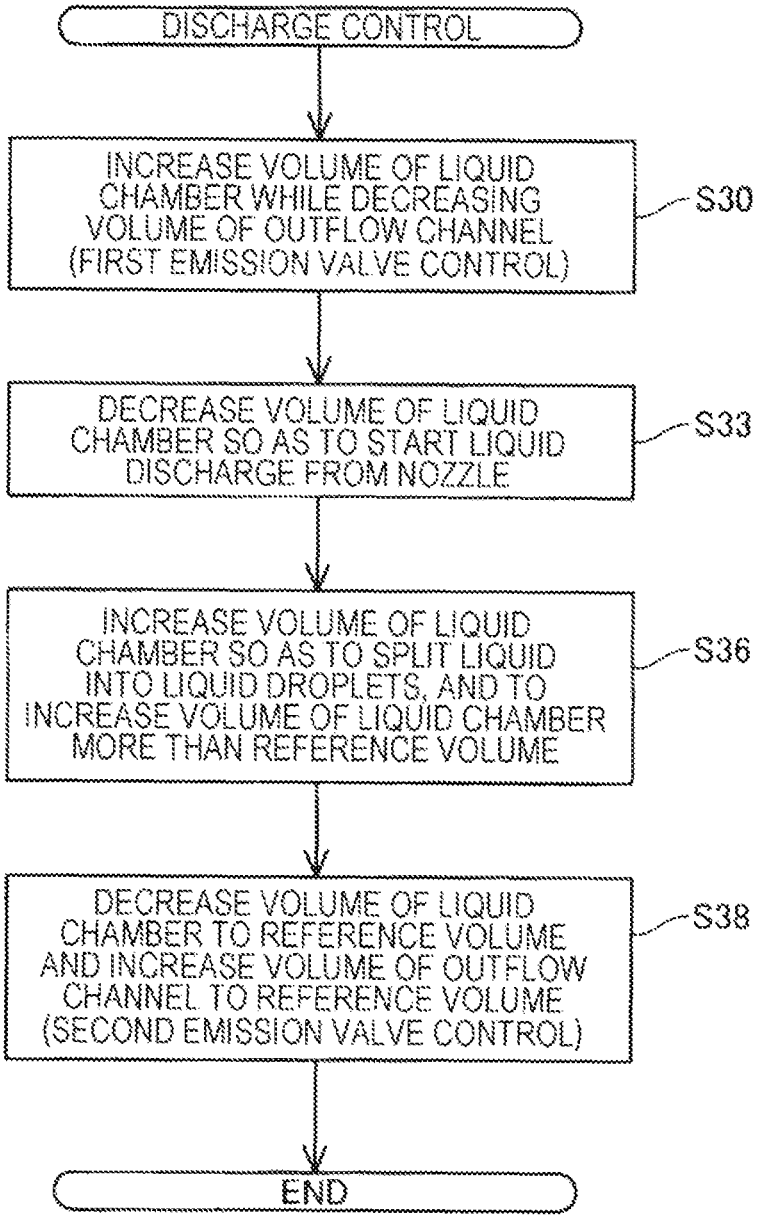
FIG. 9 is a flowchart illustrating flow of discharge control of the second embodiment.

An example of the discharge control of the head unit 40B, which is executed by the controller 80, is described with reference to FIGS. 9, 10A to 10D, and 11. FIG. 9 is a flowchart illustrating flow of the discharge control of the second embodiment. FIGS. 10A to 10D are schematic views illustrating an operation of the head unit 40B in control steps.

The controller 80 causes the head unit 40B to come into the initial state before the execution of the discharge control. In the initial state, the controller 80 adjusts an inflow amount and an outflow amount of the liquid LQ in the liquid chamber 42 such that the leaking of the liquid LQ from the nozzle 41 does not occur and the internal pressure of the liquid chamber 42 is equal to the predetermined reference pressure that is equal to or lower than the meniscus resistance pressure of the nozzle 41. In addition, the controller 80 adjusts the volume of the liquid chamber 42 so as to become the predetermined reference volume and adjusts the volume of the outflow channel 51 so as to become the predetermined reference volume. Similar to the first embodiment, the reference volume of the liquid chamber 42 may be a volume of the liquid chamber 42 which is obtained when voltage for the expansion/contraction motion is not applied to the liquid chamber driving unit 43 and the top surface 45 is not bent and deformed. In addition, the reference volume of the outflow channel 51 may be a volume of the outflow channel 51 which is obtained when voltage for the expansion/contraction motion is not applied to the driving unit 55 of the emission valve 53 and the flow channel wall member 54 is not bent and deformed. Hereinafter, the flow-channel resistance of the outflow channel 51 obtained when the outflow channel has the reference volume is referred to as "reference resistance".

Figure 10A:
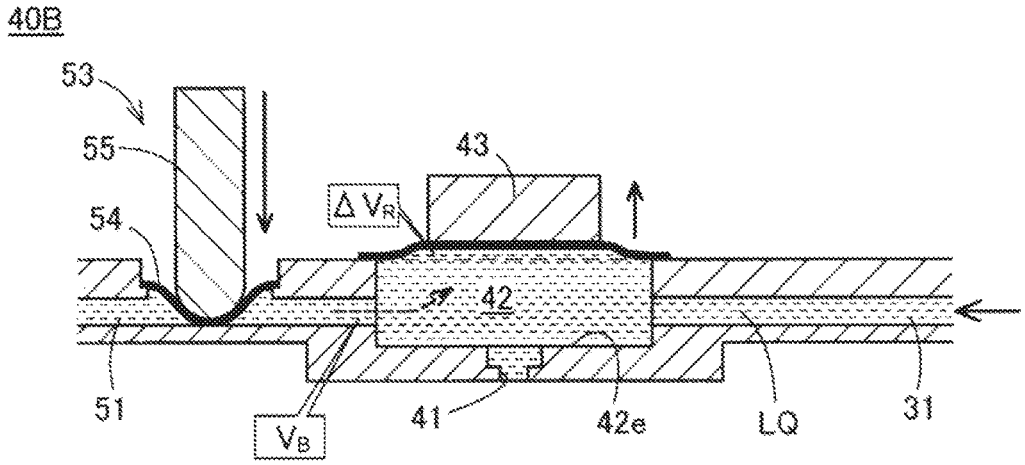
FIG. 10A is a first schematic view illustrating an operation of the head unit in the discharge control.

Step S30 is a step for preparing a start of discharge of the liquid LQ from the nozzle 41. In Step S30, the controller 80 decreases the volume of the outflow channel 51 so as to increase the volume of the liquid chamber 42 from the reference volume while increasing the flow-channel resistance of the outflow channel 51 from the reference resistance (FIG. 10A). The controller 80 decreases the volume of the outflow channel 51 to a predetermined minimum volume. The minimum volume may be a volume obtained by blocking the outflow channel 51 described above.

Here, a change amount $\Delta V_R$ of the volume of the liquid chamber 42 in the increase direction in Step S30 is equal to or larger than a volume $V_B$ of the liquid LQ flowing from the outflow channel 51 into the liquid chamber 42 by causing the emission valve 53 to change the volume of the outflow channel 51 ($\Delta V_R \geq V_B$). The volume $V_B$ corresponds to an amount of the liquid LQ that is pushed from the outflow channel 51 to the liquid chamber 42 by causing the emission valve 53 to decrease the volume of the outflow channel 51. In addition, the volume $V_B$ corresponds to an amount of the liquid LQ that is suctioned from the liquid chamber 42 into the outflow channel 51 by causing the emission valve 53 to increase the volume of the outflow channel 51. Hereinafter, the volume $V_B$ of the liquid LQ is referred to as an "emission-side movement volume $V_B$". A method of obtaining the emission-side movement volume $V_B$ will be described below.

In Step S30, a buffer space for receiving at least the liquid LQ corresponding to the emission-side movement volume $V_B$ is formed in the liquid chamber 42 due to the increase in volume by the change amount $\Delta V_R$ in the liquid chamber 42. Accordingly, leaking of the liquid LQ from the nozzle 41 due to the liquid LQ pushed to the liquid chamber 42 by the operation of the emission valve 53 in a direction, in which the outflow channel 51 is closed, is suppressed.

It is desirable that the change amount $\Delta V_R$ of the volume of the liquid chamber 42 in Step S30 is set in a range in which a state of forming the meniscus in the nozzle 41 is maintained, in order to suppress the entering of the external air from the nozzle 41. In addition, the change amount $\Delta V_R$ of the volume of the liquid chamber 42 may be a value obtained by adding, to the emission-side movement volume $V_B$, a volume of the liquid LQ, which corresponds to the discharge amount of the liquid LQ from the nozzle 41 in the following steps.

Figure 10B:
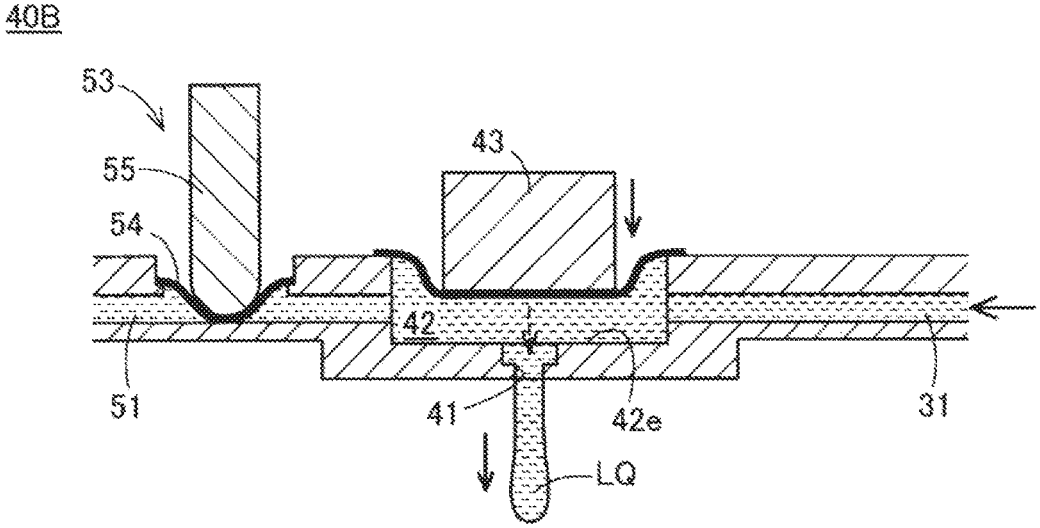
FIG. 10B is a second schematic view illustrating the operation of the head unit in the discharge control.

Step S33 is a step for starting the discharge of the liquid LQ from the nozzle 41. In Step S33, the controller 80 causes the liquid chamber driving unit 43 to rapidly elongate so as to decrease the volume of the liquid chamber 42 (FIG. 10B). In this manner, the liquid LQ is pushed from the liquid chamber 42 and the liquid LQ starts to be ejected from the nozzle 41. At this time, since the flow-channel resistance of the outflow channel 51 is increased in Step S30, a loss of the pressure generated in the liquid chamber 42 in order to discharge the liquid LQ, to the outflow channel 51, is suppressed.

Figure 10C:
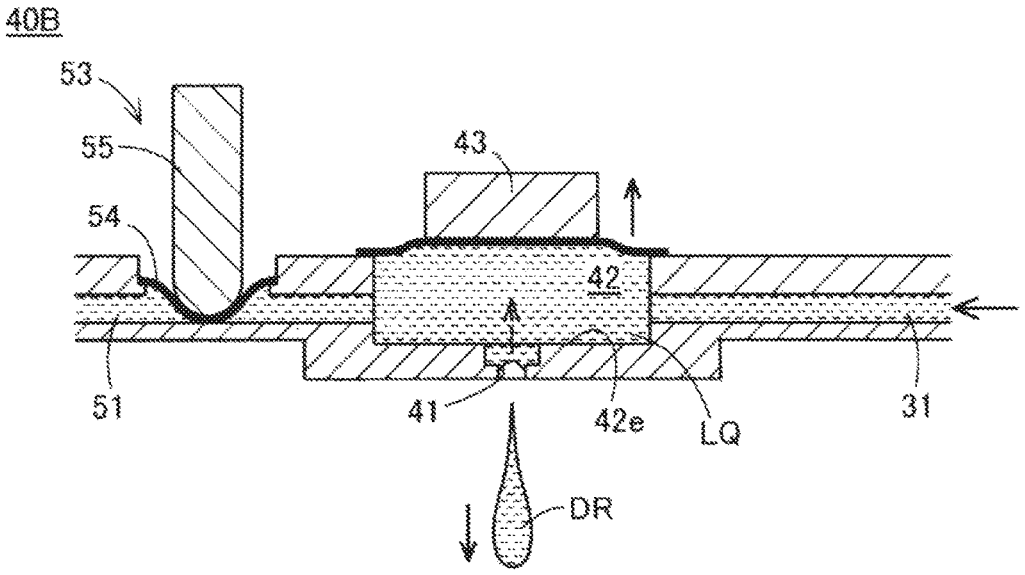
FIG. 10C is a third schematic view illustrating the operation of the head unit in the discharge control.

Step S36 is a step for splitting the liquid LQ discharged from the nozzle 41 into liquid droplets DR. In Step S36, the controller 80 contracts the liquid chamber driving unit 43 during the discharge of the liquid LQ from the nozzle 41 so as to increase the volume of the liquid chamber 42, thereby reducing the pressure of the liquid chamber 42 (FIG. 10C). In this manner, a force of suctioning the liquid LQ back to the liquid chamber 42 from the nozzle 41 is generated, and thus the liquid LQ discharged out from the nozzle 41 can be separated from the liquid LQ of the nozzle 41 and can fly as the liquid droplets DR.

In addition, in Step S36, the controller 80 causes the volume of the liquid chamber 42 to be larger than the reference volume, in order to prepare the valve opening operation of the emission valve 53 in Step S38. It is desirable that the controller 80 causes the volume of the liquid chamber 42 to be larger than the reference volume by an amount corresponding to the change amount $\Delta V_R$ of the volume of the liquid chamber 42 in Step S38 to be described below.

Figure 10D:
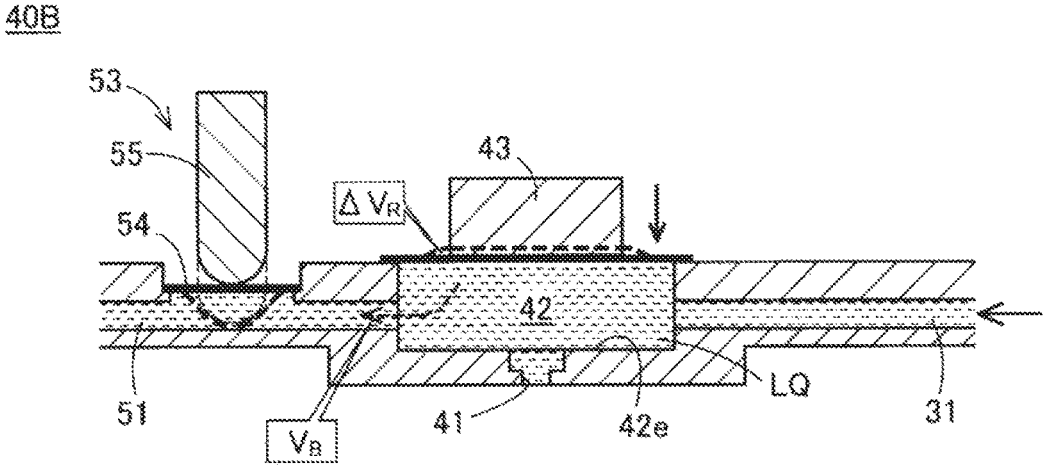
FIG. 10D is a fourth schematic view illustrating the operation of the head unit in the discharge control.

In Step S38, the controller 80 causes the liquid chamber driving unit 43 to decrease the volume of the liquid chamber 42 such that the volume of the liquid chamber 42 returns to the reference volume while causing the emission valve 53 to perform the valve opening operation of increasing the volume of the outflow channel 51 (FIG. 10D). In addition, in Step S38, the controller 80 increases the volume of the outflow channel 51 so as to become the reference volume such that the flow-channel resistance of the outflow channel 51 becomes the reference resistance.

Similar to Step S30, the change amount $\Delta V_R$ of the volume of the liquid chamber 42 in Step S38 is a value equal to or larger than the emission-side movement volume $V_B$. In Step S38, since the volume of the liquid chamber 42 is decreased while the valve opening operation of the emission valve 53 is not performed, the suction of the external air from the nozzle 41 to the liquid chamber 42 due to the suction force of the liquid LQ to the emission valve 53, which is generated due to the increase in volume of the outflow channel 51, is suppressed.

Figure 11:
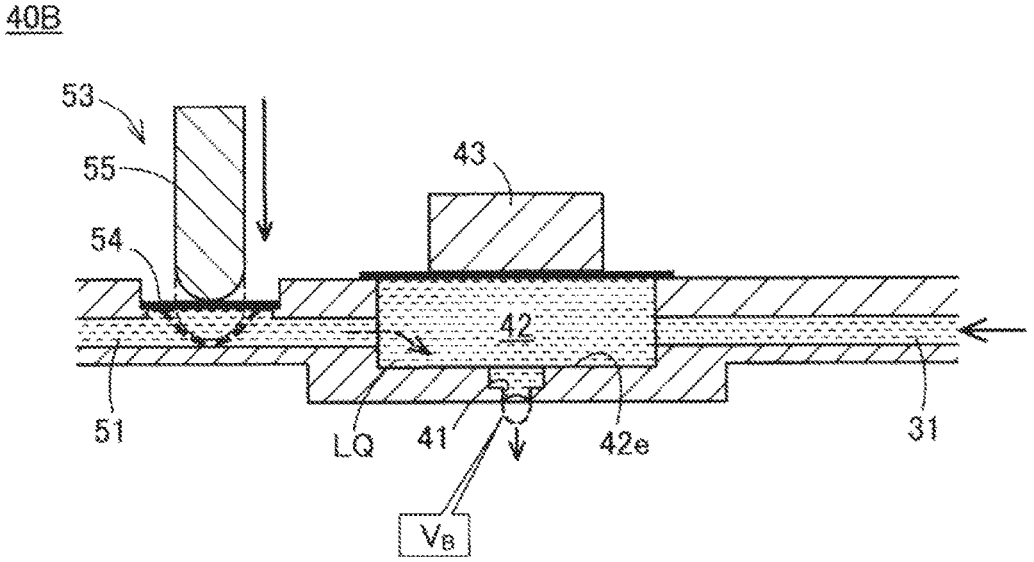
FIG. 11 is a schematic view for illustrating a method of obtaining an emission-side movement volume.

FIG. 11 is a schematic view for illustrating the method of obtaining the emission-side movement volume $V_B$. The emission-side movement volume $V_B$ can be obtained as follow. The inflow channel 31, the outflow channel 51, and the liquid chamber 42 are filled with the liquid LQ and the head unit 40B comes into the initial state described above. At this time, a position of the meniscus in the nozzle 41 is recorded. Without causing the liquid chamber driving unit 43 to change the volume of the liquid chamber 42, the emission valve 53 decreases the volume of the outflow channel 51 to the minimum volume, and an amount of increase of the liquid LQ from the position of the meniscus described above in the initial state is obtained. The amount of increase corresponds to the emission-side movement volume $V_B$. The emission-side movement volume $V_B$ may be obtained as an amount of decrease of the liquid LQ in the liquid chamber 42 and the nozzle 41 when the volume of the outflow channel 51 returns from the minimum volume to the reference volume.

Figure 12:
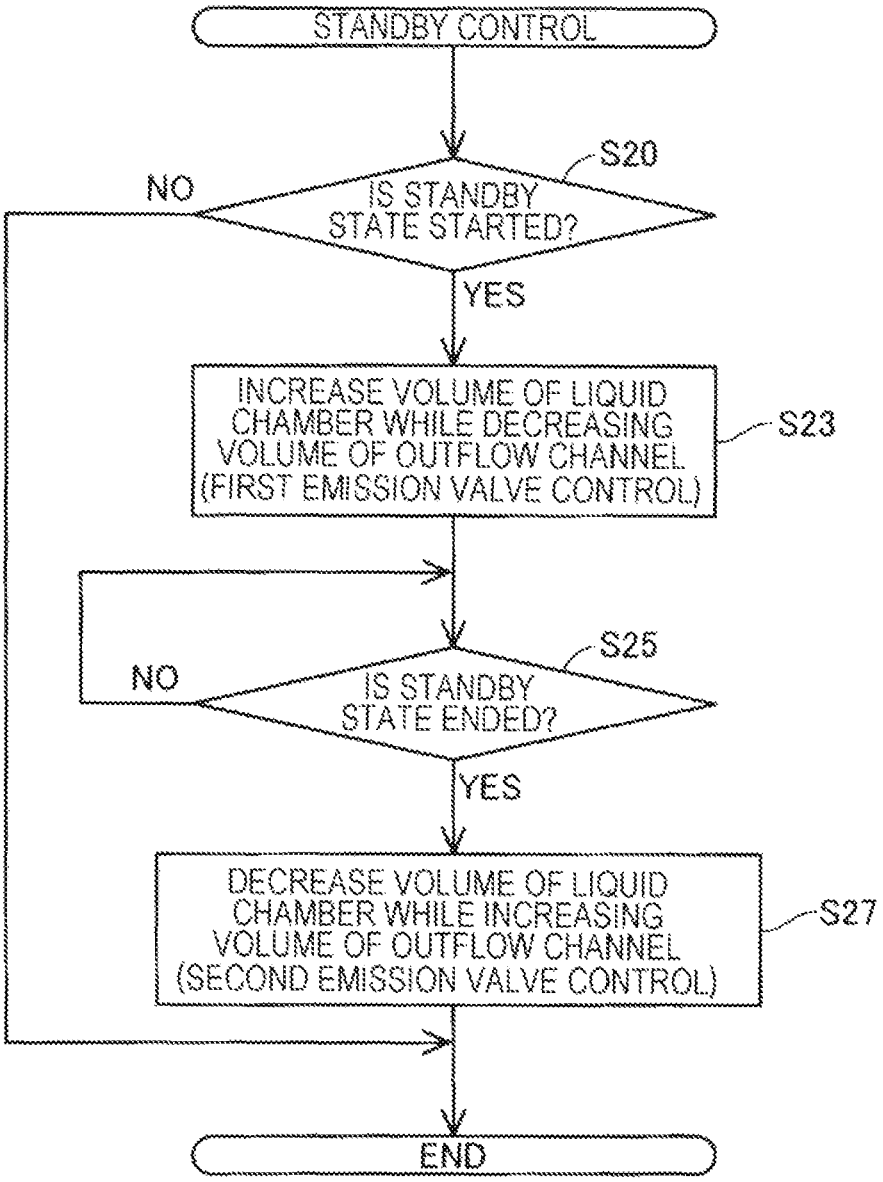
FIG. 12 is a flowchart illustrating flow of standby control in the second embodiment.

An example of standby control of the head unit 40B, which is executed by the controller 80 (FIG. 7), is described with reference to FIG. 12. FIG. 12 is a flowchart illustrating flow of the standby control of the second embodiment. The flow of the standby control of the second embodiment is the same as the flow (FIG. 6) of the standby control of the first embodiment except that Steps S23 and S27 of driving the emission valve 53 are provided, instead of Steps S22 and S26 of driving the supply valve 33.

When the controller 80 determines to cause the head unit 40B to come into the standby state in Step S20, the controller executes a process of Step S23. In Step S23, similar to Step S30 (FIGS. 9 and 10A) in the discharge control, the controller 80 causes the liquid chamber driving unit 43 to increase the volume of the liquid chamber 42 such that the head unit 40B comes into the standby state while causing the emission valve 53 to decrease the volume of the outflow channel 51. In Step S23, since the volume of the liquid chamber 42 is increased in association with a valve closing operation of the emission valve 53, leaking of the liquid LQ from the nozzle 41 due to the liquid LQ pushed from the outflow channel 51 is suppressed. It is desirable that the change amount $\Delta V_R$ of the volume of the liquid chamber 42 in Step S23 is a value equal to or smaller than the change amount $\Delta V_R$ in Step S30 in the discharge control such that a pressure change does not occur accidentally in the liquid chamber 42. In addition, in Step S23, it is desirable that the outflow channel 51 comes into a substantially blocked state by the emission valve 53.

When the standby state is canceled, the controller 80 executes a process of Step S27. In Step S27, similar to Step S38 (FIGS. 9 and 10D) in the discharge control, the controller 80 causes the liquid chamber driving unit 43 to decrease the volume of the liquid chamber 42 such that the volume of the liquid chamber 42 returns to the reference volume while causing the emission valve 53 to perform the valve opening operation of increasing the volume of the outflow channel 51. Similar to Step S23, the change amount $\Delta V_R$ of the volume of the liquid chamber 42 in Step S27 is a value equal to or larger than the emission-side movement volume $V_B$. Similar to Step S38 in the discharge control, in Step S27, the suction of the external air from the nozzle 41 in association with the valve opening operation of the emission valve 53 is suppressed.

Of the control of the head unit 40B by the controller 80, "first emission valve control" means control of increasing the volume of the liquid chamber 42 while decreasing the volume of the outflow channel 51, such that the change amount $\Delta V_R$ of the volume of the liquid chamber 42 is equal to or larger than the emission-side movement volume $V_B$, as described in Steps S30 and S23 (FIGS. 9 and 12). In addition, "second emission valve control" means control of decreasing the volume of the liquid chamber 42 while increasing the volume of the outflow channel 51, such that the change amount $\Delta V_R$ of the volume of the liquid chamber 42 is equal to or larger than the emission-side movement volume $V_B$, as described in Steps S38 and S27 (FIGS. 9 and 12).

According to the liquid discharge apparatus 100B of the second embodiment, the first emission valve control suppresses the leaking of the liquid LQ from the nozzle 41 due to the valve closing operation of the emission valve 53. In addition, the second emission valve control suppresses the entering of the external air from the nozzle 41 to the liquid chamber 42 due to the valve opening operation of the emission valve 53. Additionally, according to the liquid discharge apparatus 100B and the method for controlling the liquid discharge apparatus of the second embodiment, it is possible to achieve the same types of various operational effects as described in the first and second embodiments described above.

C. Third Embodiment

Figure 13:
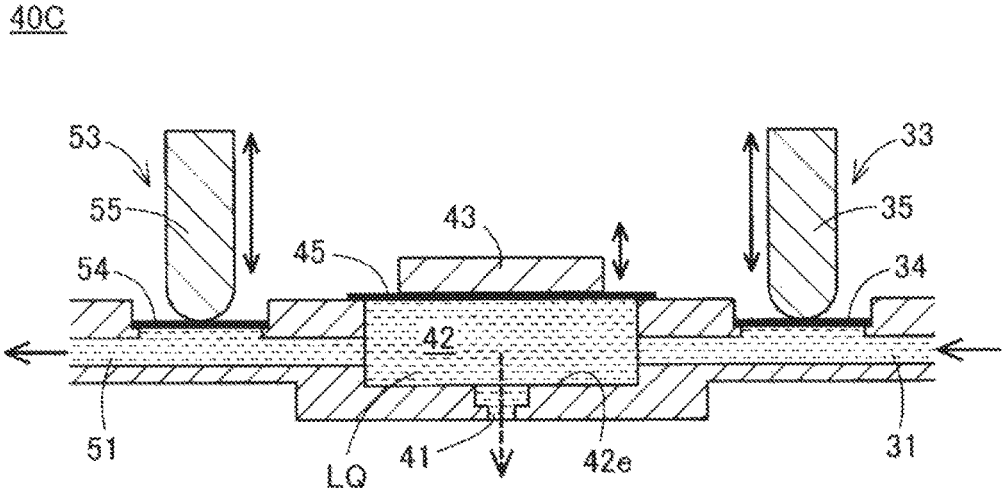
FIG. 13 is a schematic sectional view illustrating an internal configuration of a head unit in a third embodiment.

FIG. 13 is a schematic sectional view illustrating an internal configuration of a head unit 40C included in the liquid discharge apparatus in a third embodiment. FIG. 13 schematically illustrates the configuration of the head unit 40C on a section plane through the central axis of the nozzle 41 and the inflow channel 31 and the outflow channel 51.

The liquid discharge apparatus of the third embodiment has substantially the same configuration as the configuration (FIG. 7) of the liquid discharge apparatus 100B of the second embodiment, except that the head unit 40C of the third embodiment is provided, instead of the head unit 40B of the second embodiment. The head unit 40C of the third embodiment has substantially the same configuration as the configuration (FIG. 8) of the head unit 40B of the second embodiment, except that the inflow channel 31 is provided with the supply valve 33 described in the first embodiment. The head unit 40C may include two or more nozzles 41 and two or more liquid chambers 42.

Figure 14:
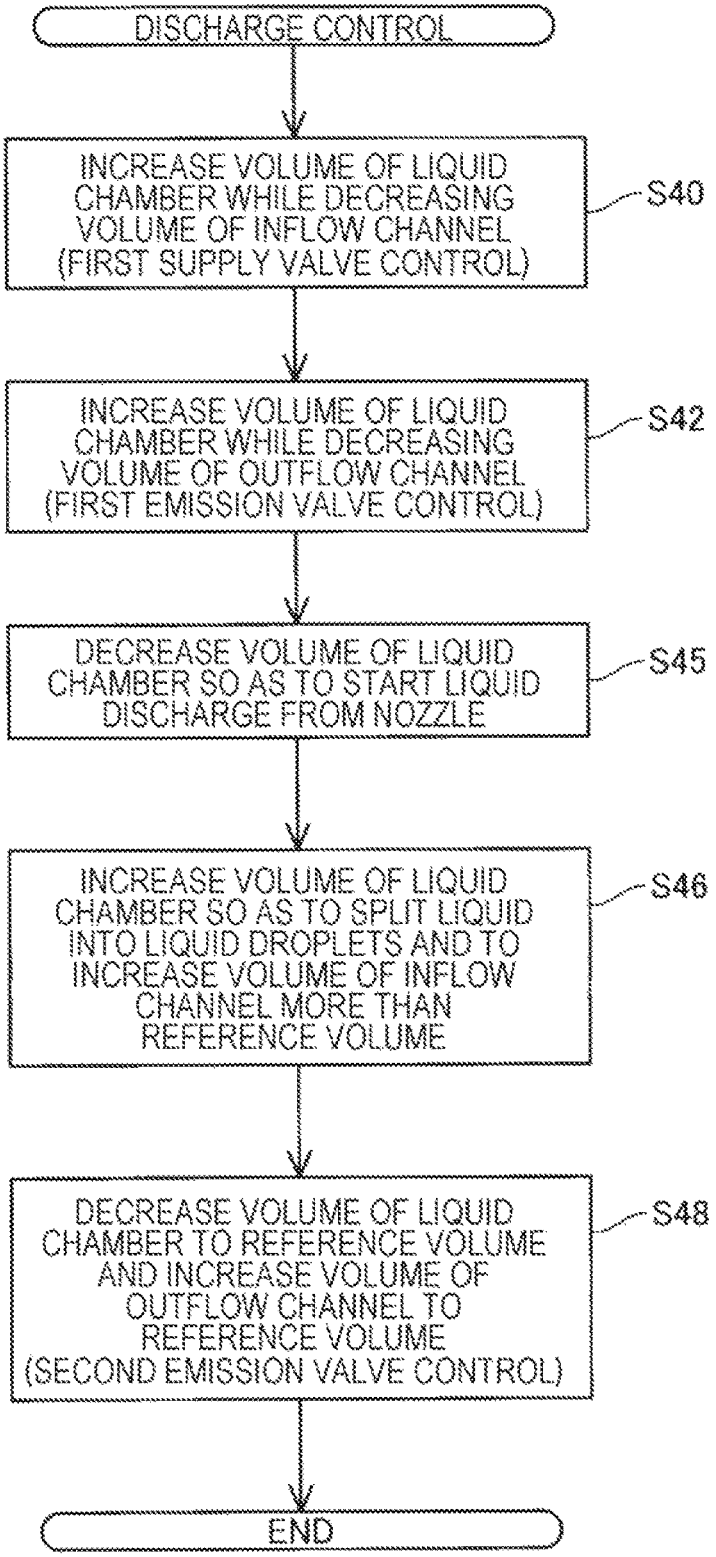
FIG. 14 is a flowchart illustrating flow of discharge control of the third embodiment.

An example of the discharge control of the head unit 40C, which is executed by the controller 80 (FIG. 7) in the liquid discharge apparatus of the third embodiment, is described with reference to FIG. 14. FIG. 14 is a flowchart illustrating flow of the discharge control. In the discharge control of the third embodiment, the discharge control (FIG. 3) of the first embodiment and the discharge control (FIG. 9) of the second embodiment are combined.

Step S40 is the first supply valve control described in the first embodiment. In Step S40, similar to Step S10 (FIG. 3) described in the first embodiment, the controller 80 decreases the volume of the inflow channel 31 so as to increase the volume of the liquid chamber 42 from the reference volume while increasing the flow-channel resistance of the inflow channel 31 from the reference resistance. The change amount $\Delta V_R$ of the volume of the liquid chamber 42 in Step S40 is an amount equal to or larger than the supply-side movement volume $V_A$ (FIG. 5) described in the first embodiment ($\Delta V_R \geq V_A$). In this manner, the leaking of the liquid LQ from the nozzle 41 due to the valve closing operation of the supply valve 33 is suppressed.

Step S42 is the first emission valve control described in the second embodiment. In Step S42, similar to Step S30 (FIG. 9) described in the second embodiment, the controller 80 decreases the volume of the outflow channel 51 so as to increase the volume of the liquid chamber 42 while increasing the flow-channel resistance of the outflow channel 51 from the reference resistance. In Step S42, the volume of the liquid chamber 42 is more increased from the volume increased in Step S40. The change amount $\Delta V_R$ of the volume of the liquid chamber 42 in Step S42 is an amount equal to or larger than the emission-side movement volume $V_B$ (FIG. 11) described in the second embodiment ($\Delta V_R \geq V_B$). In this manner, the leaking of the liquid LQ from the nozzle 41 due to the valve closing operation of the emission valve 53 is suppressed.

In Step S45, similar to Step S13 (FIG. 3) of the first embodiment, the controller 80 causes the liquid chamber driving unit 43 to rapidly elongate so as to decrease the volume of the liquid chamber 42. In this manner, the liquid LQ is pushed from the liquid chamber 42 and the liquid LQ starts to be ejected from the nozzle 41. At this time, since the flow-channel resistances of the inflow channel 31 and the outflow channel 51 are increased in Steps S40 and S42, a loss of the pressure generated in the liquid chamber 42 in order to discharge the liquid LQ, to the inflow channel 31 and the outflow channel 51, is suppressed.

In Step S46, the controller 80 increases the volume of the liquid chamber 42 during the discharge of the liquid LQ from the nozzle 41 so as to generate a suction force for suctioning the liquid LQ from the nozzle 41 back to the liquid chamber 42. In this manner, the liquid LQ discharged out from the nozzle 41 is separated from the liquid LQ of the nozzle 41 and flies as the liquid droplets DR. In addition, the controller 80 gradually increases the volume of the inflow channel 31 so as to become the reference volume such that the flow-channel resistance of the inflow channel 31 returns to the reference resistance. The controller 80 increases the volume of the liquid chamber 42 such that the volume is larger than the reference volume while changing the volume of the inflow channel 31.

Step S48 is the second emission valve control described in the second embodiment. In Step S48, similar to Step S38 (FIG. 9) described in the second embodiment, the controller 80 causes the liquid chamber driving unit 43 to decrease the volume of the liquid chamber 42 such that the volume of the liquid chamber 42 returns to the reference volume while causing the emission valve 53 to perform the valve opening operation of increasing the volume of the outflow channel 51 to the reference volume. The change amount $\Delta V_R$ of the volume of the liquid chamber 42 in Step S48 is a value equal to or larger than the emission-side movement volume $V_B$ (FIG. 11) described in the second embodiment. In this manner, the suction of the external air from the nozzle 41 to the liquid chamber 42 due to the valve opening operation of the supply valve 33 is suppressed.

Figure 15:
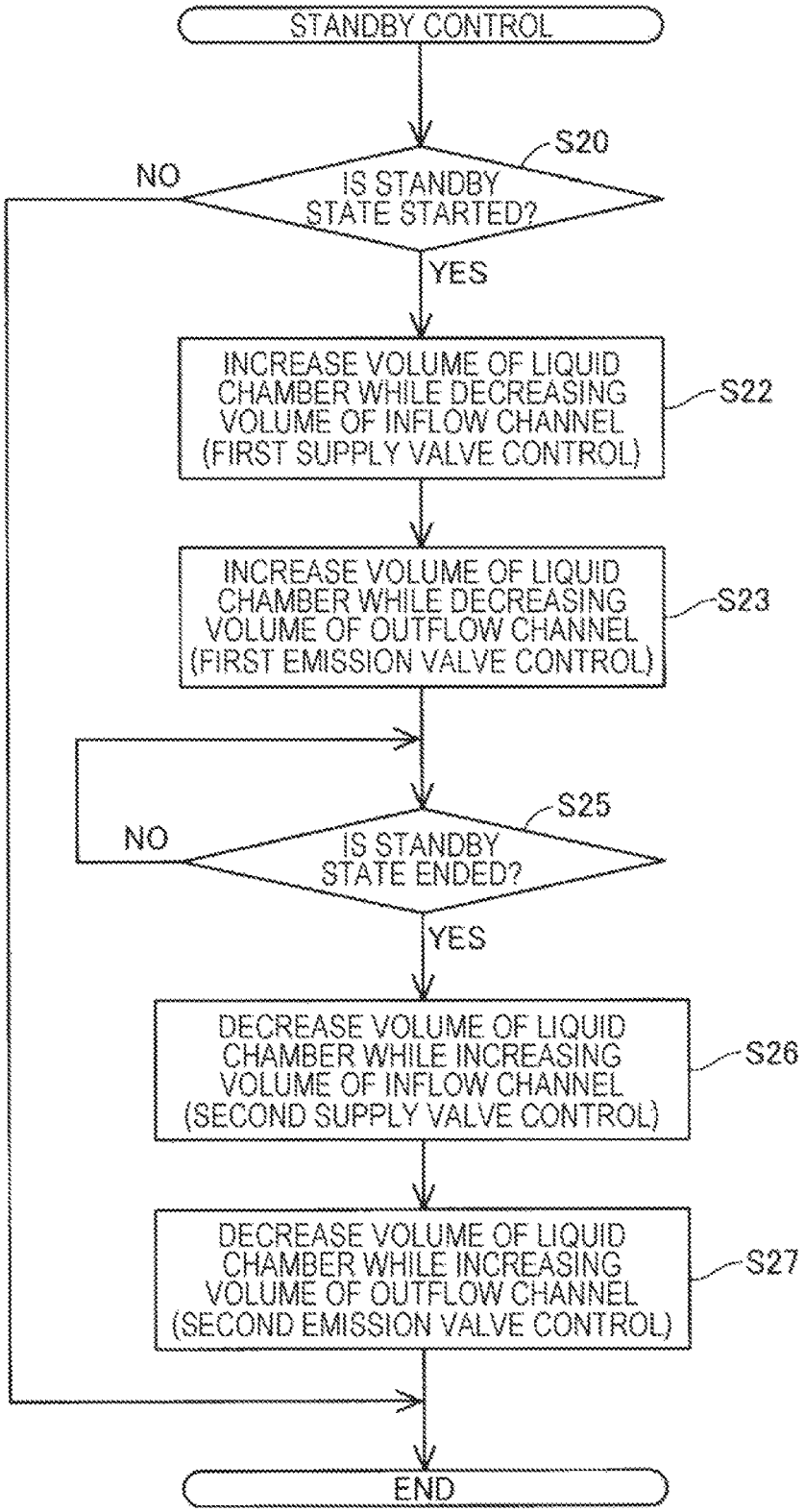
FIG. 15 is a flowchart illustrating flow of standby control in the third embodiment.

An example of the standby control of the head unit 40C, which is executed by the controller 80 in the liquid discharge apparatus of the third embodiment, is described with reference to FIG. 15. FIG. 15 is a flowchart illustrating flow of the standby control of the third embodiment. In the standby control of the third embodiment, the standby control (FIG. 6) of the first embodiment and the standby control (FIG. 12) of the second embodiment are combined.

In the control flow of the third embodiment, the controller 80 executes Step S22 and Step S23 in this order in a case where the controller determines to cause the head unit 40C to come into the standby state in Step S20. Step S22 is the first supply valve control described in the first embodiment (FIG. 6). Step S23 is the first emission valve control described in the second embodiment (FIG. 12). An execution order of Step S22 and Step S23 may be transposed.

In a case where the standby state of the head unit 40C is canceled, the controller 80 executes Step S26 and Step S27 in this order. Step S26 is the second supply valve control described in the first embodiment (FIG. 6). Step S27 is the second emission valve control described in the second embodiment (FIG. 12). An execution order of Step S26 and Step S27 may be transposed.

According to the liquid discharge apparatus of the third embodiment, the first supply valve control suppresses the leaking of the liquid LQ from the nozzle 41 due to the valve closing operation of the supply valve 33. In addition, the first emission valve control suppresses the leaking of the liquid LQ from the nozzle 41 due to the valve closing operation of the emission valve 53. According to the liquid discharge apparatus of the third embodiment, the second supply valve control suppresses the entering of the external air from the nozzle 41 into the liquid chamber 42 due to the valve opening operation of the supply valve 33. In addition, the second emission valve control suppresses the entering of the external air from the nozzle 41 to the liquid chamber 42 due to the valve opening operation of the emission valve 53. Additionally, according to the liquid discharge apparatus and the method for controlling the liquid discharge apparatus of the third embodiment, it is possible to achieve the same types of various operational effects as described in the embodiments.

D. Fourth Embodiment

Figure 16:
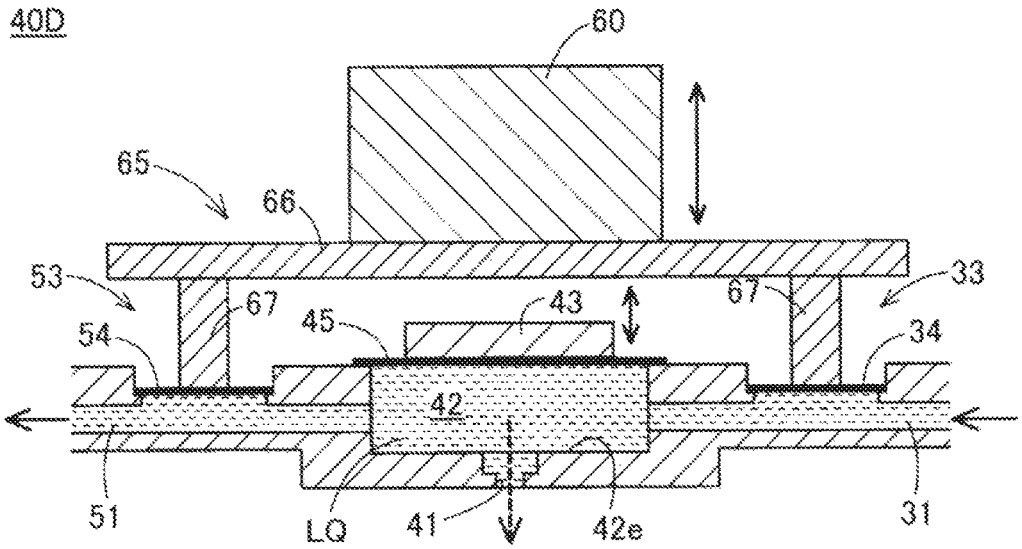
FIG. 16 is a schematic sectional view illustrating an internal configuration of a head unit in a fourth embodiment.
Figure 17:
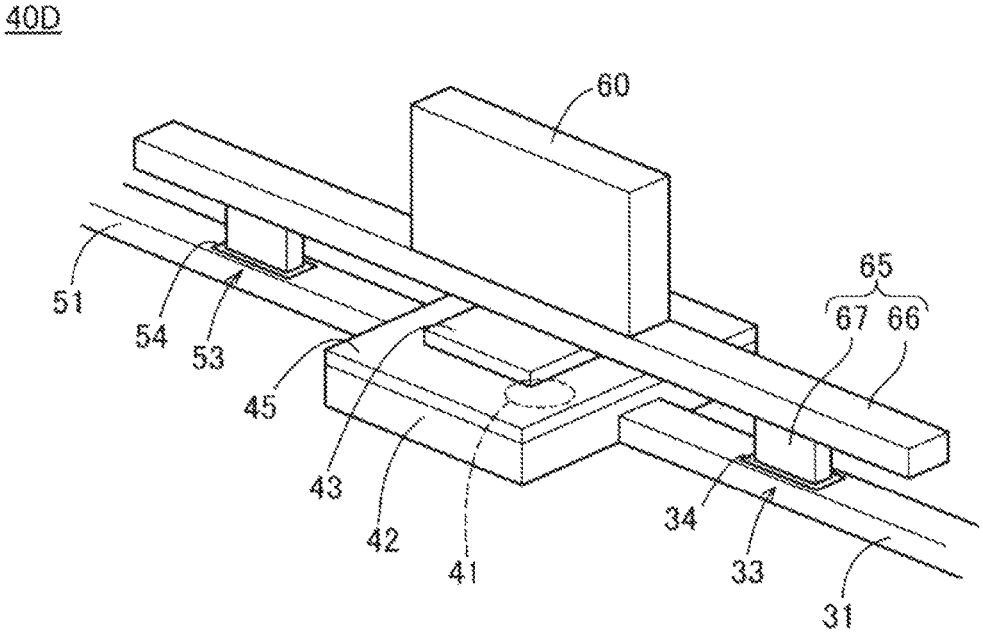
FIG. 17 is a schematic perspective view illustrating the internal configuration of the head unit in the fourth embodiment.

A configuration of a head unit 40D included in the liquid discharge apparatus of a fourth embodiment is described with reference to FIGS. 16 and 17. FIG. 16 is a schematic sectional view illustrating an internal configuration of the head unit 40D in the fourth embodiment. FIG. 16 schematically illustrates the configuration of the head unit 40D on a section plane through the central axis of the nozzle 41 and the inflow channel 31 and the outflow channel 51. FIG. 17 is a schematic perspective view illustrating the internal configuration of the head unit 40D.

The configuration of the liquid discharge apparatus of the fourth embodiment is substantially the same as the configuration (FIG. 7) of the liquid discharge apparatus 100B of the second embodiment, except that the head unit 40D is provided, instead of the head unit 40B. The configuration of the head unit 40D of the fourth embodiment is substantially the same as the configuration (FIG. 13) of the head unit 40C of the third embodiment, except that one driving unit 60 is provided, instead of the two driving units 35 and 55, and a connection member 65 is provided.

The head unit 40D of the fourth embodiment includes the driving unit 60 common to the supply valve 33 and the emission valve 53. The driving unit 60 applies a drive force to the supply valve 33 and the emission valve 53 under the control of the controller 80 (FIG. 7) so as to change the volumes of the inflow channel 31 and the outflow channel 51. The driving unit 60 applies an external force as the drive force via the connection member 65, for causing the flow channel wall member 34 of the supply valve 33 and the flow channel wall member 54 of the emission valve 53 to be bent and deformed. The driving unit 60 is configured of a piezoelectric actuator that is expandable and contractible in the vertical direction and performs the expansion/contraction motion in the vertical direction, thereby causing the flow channel wall member 34 of the supply valve 33 and the flow channel wall member 54 of the emission valve 53, which are connected to the connection member 65, to be vertically bend and deformed together.

The connection member 65 includes a bridge portion 66 and two connection portions 67. The bridge portion 66 is configured as a column-shaped portion which straddles over the supply valve 33 and the emission valve 53. The bridge portion 66 is disposed above the liquid chamber driving unit 43 that is disposed on the liquid chamber 42. The connection portions 67 are configured as projecting portions that project downward from the bridge portion 66. A lower end portion of a first connection portion 67 is connected to the flow channel wall member 34 of the supply valve 33, and a lower end portion of a second connection portion 67 is connected to the flow channel wall member 54 of the emission valve 53. When the driving unit 60 performs the expansion/contraction motion, the connection member 65 is vertically shifted, and the flow channel wall members 34 and 54 are bent and deformed. In the head unit 40D, a cycle of change of the flow-channel resistance of the inflow channel 31 and a cycle of change of the flow-channel resistance of the outflow channel 51 are synchronized with each other.

Figure 18:
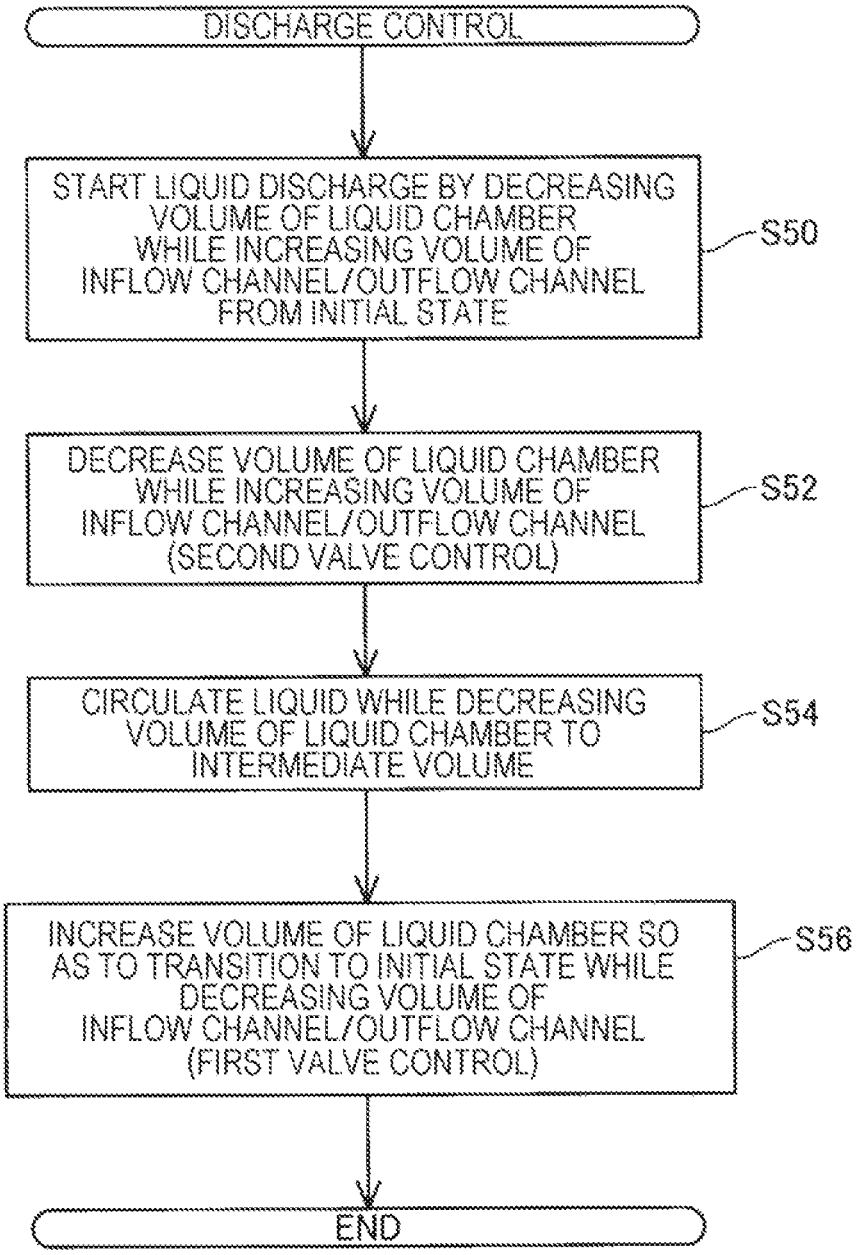
FIG. 18 is a flowchart illustrating flow of discharge control of the fourth embodiment.
Figure 19:
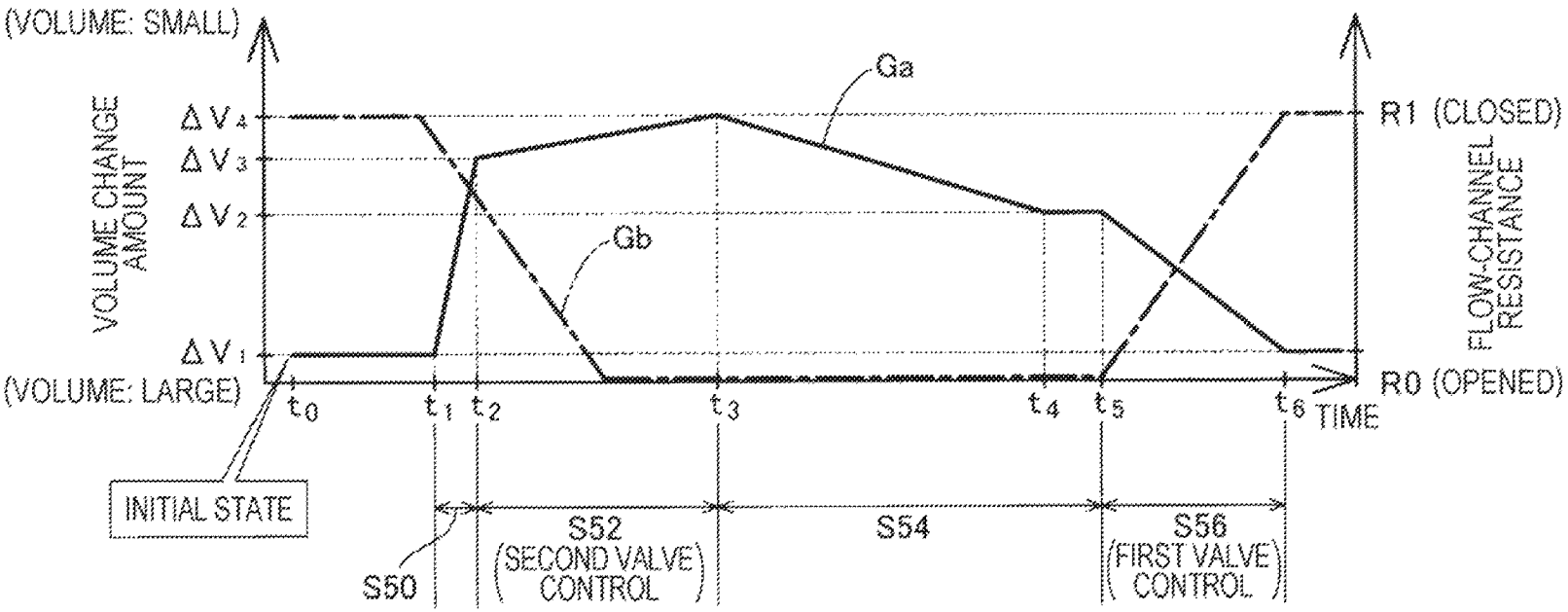
FIG. 19 is a timing chart in the discharge control of the fourth embodiment.

An example of discharge control of the head unit 40D, which is executed by the controller 80, is described with reference to FIGS. 18, 19, and 20. FIG. 18 is a flowchart illustrating flow of the discharge control of the fourth embodiment. FIG. 19 is a timing chart illustrating the change in volume of the liquid chamber 42 and the change in the flow-channel resistance in the discharge control of the fourth embodiment. In FIG. 19, the horizontal axis represents elapsed time. The vertical axis on the left side on the paper surface of FIG. 19 represents a volume change amount which is the amount of change of the volume of the liquid chamber 42 from the reference volume. The larger the value of the volume change amount, the smaller the volume of the liquid chamber 42. The volume change amounts $\Delta V_1$, $\Delta V_2$, $\Delta V_3$, and $\Delta V_4$ in FIG. 19 satisfy a relationship of $\Delta V_1<\Delta V_2<\Delta V_3<\Delta V_4$. The vertical axis on the right side on the paper surface of FIG. 19 represents the flow-channel resistance in the inflow channel 31 and the outflow channel 51. The larger the value of the flow-channel resistance, the larger the elongation/deformation amount of the driving unit 60. Thus, the volumes in the supply valve 33 and the emission valve 53 are small. In FIG. 19, a graph Ga of a solid line indicates a time change of the volume change amount, and a graph Gb of a dot-and-dash line indicates a time change of a degree of opening of the flow channel.

The controller 80 causes the head unit 40D to come into the initial state before the execution of the discharge control (FIG. 19). The controller 80 causes the volume of the liquid chamber 42 to be slightly decreased by $\Delta V_1$ from the reference volume at a time point $t_0$ before the discharge of the liquid LQ from the nozzle 41 is started. In addition, the respective flow-channel resistances of the inflow channel 31 and the emission valve 53 are set to the maximum value R1. When the flow-channel resistance is the maximum value R1, the maximum elongation amount of the driving unit 60 is obtained, and the inflow channel 31 and the outflow channel 51 come into a substantially blocked state.

Step S50 (FIG. 18) is a step for starting the discharge of the liquid LQ from the nozzle 41. As described above, in Step S50, while the volumes of the inflow channel 31 and the outflow channel 51 are increased from the initial state described above, the volume of the liquid chamber 42 is decreased such that the liquid LQ is discharged from the nozzle 41.

Step S50 is executed between time points $t_1$ and $t_2$ (FIG. 19). Between the time points $t_1$ and $t_2$, controller 80 causes the liquid chamber driving unit 43 to be rapidly elongated and deformed so as to decrease the volume of the liquid chamber 42 by $\Delta V_3$ from the reference volume, and the pressure of the liquid chamber 42 is rapidly increased. The liquid starts to be ejected from the nozzle 41 with the pressure as the drive force. On the other hand, the controller 80 causes the driving unit 60 to start contraction deformation before and after the time point $t_1$ and decreases the flow-channel resistances of the inflow channel 31 and the outflow channel 51. A change rate of the flow-channel resistance is slower than a change rate of the volume of the liquid chamber 42. Between the time points $t_1$ and $t_2$, the flow-channel resistance is relatively high, and thus a loss of the pressure of the liquid chamber 42 for discharging the liquid, which is applied by the driving of the liquid chamber driving unit 43, from the inflow channel 31 or the outflow channel 51, is suppressed.

Step S52 (FIG. 18) is a step of opening the inflow channel 31 and the outflow channel 51 while the liquid LQ is discharged from the nozzle 41. In Step S52, as will be described below, the volumes of the inflow channel 31 and the outflow channel 51 is further increased, and the volume of the liquid chamber 42 is decreased.

Step S52 is executed between time points $t_2$ and $t_3$ (FIG. 19). The controller 80 lowers a rate at which the liquid chamber driving unit 43 elongates from the time point $t_2$ and gradually decreases the volume of the liquid chamber 42 more than between the time points $t_1$ to $t_2$, and the minimum volume of the liquid chamber 42 is obtained when the volume of the liquid chamber 42 is reduced by $\Delta V_4$ from the reference volume, at a time point $t_3$. On the other hand, even after the time point $t_2$, the controller 80 causes the driving unit 60 to continue the contraction deformation so as to decrease the flow-channel resistances in the inflow channel 31 and the outflow channel 51, and the flow-channel resistance becomes the minimum value R0 before the time point $t_3$.

Between time points $t_2$ and $t_3$, the flow-channel resistance becomes the minimum value R0, and the inflow channel 31 and the outflow channel 51 come into the opened state. In this manner, it is possible to rapidly lower the pressure of the liquid chamber 42 and it is possible to generate the suction force of suctioning the liquid LQ in the nozzle 41 back to the liquid chamber 42. In this manner, it is possible to separate the liquid LQ flowing out from the nozzle 41 from the liquid LQ in the nozzle 41 by the suction force, and it is possible to cause the liquid LQ discharged from the nozzle 41 to fly as the liquid droplets.

The change amount $\Delta V_R$ of the volume of the liquid chamber 42 between time points $t_2$ and $t_3$ is obtained as a difference between $\Delta V_4$ and $\Delta V_3$. The change amount $\Delta V_R$ of the volume is an amount equal to or larger than a total $V_C$ of the volume of the liquid LQ moving between each of the inflow channel 31 and the outflow channel 51 and the liquid chamber 42 due to a change in volumes of the inflow channel 31 and the outflow channel 51 ($\Delta V_R \geq V_A$). The volume $V_C$ corresponds to an amount of the liquid LQ that is pushed from the inflow channel 31 and the outflow channel 51 to the liquid chamber 42 by causing the supply valve 33 and the emission valve 53 to decrease the volumes of the inflow channel 31 and the outflow channel 51. In addition, the volume $V_C$ corresponds to an amount of the liquid LQ that is suctioned from the liquid chamber 42 into the inflow channel 31 and the outflow channel 51 by causing the supply valve 33 and the emission valve 53 to increase the volumes of the inflow channel 31 and the outflow channel 51. Hereinafter, the volume $V_C$ of the liquid LQ is referred to as a "movement volume $V_C$". A method of obtaining the movement volume $V_C$ will be described below.

Between the time points $t_2$ to $t_3$, the volume of the liquid chamber 42 is increased by the change amount $\Delta V_R$ equal to or larger than the movement volume $V_C$, and thereby the flowing of the liquid LQ from the liquid chamber 42 in association with the valve opening operation of the valves 33 and 53 is suppressed. Hence, excessive increase in suction force for suctioning the liquid LQ in the nozzle 41 described above is suppressed, and suction of the external air from the nozzle 41 to the liquid chamber 42 is suppressed.

Step S54 (FIG. 18) is a step of circulating the liquid LQ in the liquid chamber 42 while the liquid chamber driving unit 43 is contracted and the volume of the liquid chamber 42 is decreased to an intermediate volume. The intermediate volume of the liquid chamber 42 is a predetermined volume between the maximum value and the minimum value of the volume of the liquid chamber 42.

Step S54 is executed between time points $t_3$ and $t_5$ (FIG. 19). Between the time points $t_3$ and $t_4$, the controller 80 increases the volume of the liquid chamber 42 to the intermediate volume that is decreased by $\Delta V_2$ from the reference volume. The change rate of the volume of the liquid chamber 42 between the time points $t_3$ and $t_4$ is a relatively slow rate at which a state in which the meniscus is formed in the nozzle 41 is maintained, such that the entering of the external air from the nozzle 41 is suppressed. The controller 80 maintains the volume of the liquid chamber 42 at the intermediate volume to the time point $t_5$ before the next discharge timing comes.

Between the time points $t_3$ and $t_5$, the controller 80 maintains a state in which the inflow channel 31 and the outflow channel 51 are opened as the flow-channel resistance is the minimum value R0 and causes the liquid LQ in the liquid chamber 42 to circulate via the circulation channel 90 (FIG. 7). In this manner, the remaining of the liquid LQ to the next discharge and the degradation of the liquid are suppressed.

Step S56 (FIG. 18) is a step of causing the head unit 40D to come into the initial state so as to perform the next discharge. In Step S56, the volume of the liquid chamber 42 is increased to the volume in the initial state while decreasing the volumes of the inflow channel 31 and the outflow channel 51 to the minimum volumes.

Step S56 is executed between time points $t_5$ and $t_6$ (FIG. 19). The time point $t_5$ is a timing of issuing a discharge instruction, and the time point $t_6$ is a timing of starting the next discharge. At the time point $t_5$, the controller 80 causes the driving unit 60 to start the elongating deformation so as to increase the flow-channel resistance and causes the liquid chamber driving unit 43 to start the contracting deformation so as to increase the volume of the liquid chamber 42. At the time point $t_6$, the controller 80 increases the flow-channel resistance of the inflow channel 31 and the outflow channel 51 to the maximum value R1 and increases the volume of the liquid chamber 42 to the volume decreased by $\Delta V_1$ from the reference volume, such that the head unit 40D comes into the initial state.

The change amount $\Delta V_R$ of the volume of the liquid chamber 42 between time points $t_5$ and $t_6$ is obtained as a difference between $\Delta V_2$ and $\Delta V_1$. The change amount $\Delta V_R$ of the volume is an amount equal to or larger than the movement volume $V_C$ described above ($V_R \geq V_C$). The change amount $\Delta V_R$ of the volume of the liquid chamber 42 is a value obtained by adding, to the movement volume $V_C$, the volume of the liquid LQ discharged from the nozzle 41 in the next discharge. The buffer space for receiving at least the liquid LQ corresponding to the movement volume $V_C$ is formed in the liquid chamber 42 due to the increase in volume by the change amount $\Delta V_R$ in the liquid chamber 42. Accordingly, leaking of the liquid LQ from the nozzle 41 due to the liquid LQ pushed to the liquid chamber 42 by the valve closing operation of the valves 33 and 53 is suppressed.

Figure 20:
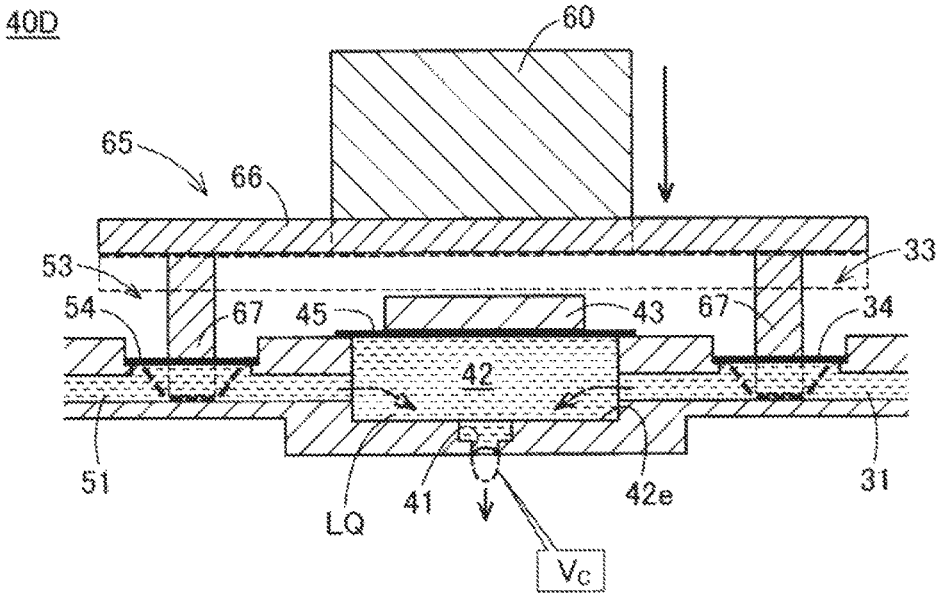
FIG. 20 is a schematic view for illustrating a method of obtaining a movement volume.

FIG. 20 is a schematic view for illustrating the method of obtaining the movement volume $V_C$. The movement volume $V_C$ can be obtained as follow. The inflow channel 31 and the outflow channel 51 come into the opened state with the minimum flow-channel resistance. In the same condition as that during normal drive of the liquid discharge apparatus, the inflow channel 31, the outflow channel 51, and the liquid chamber 42 are filled with the liquid LQ while the liquid LQ is circulated, and the position of the meniscus in the nozzle 41 is recorded. Then, without causing the liquid chamber driving unit 43 to change the volume of the liquid chamber 42, the supply valve 33 and the emission valve 53 decrease the volumes of the inflow channel 31 and the outflow channel 51 to the minimum volumes, and an amount of increase of the liquid LQ from the position of the recorded meniscus is obtained. The amount of increase corresponds to the movement volume $V_C$. The movement volume $V_C$ may be obtained as an amount of decrease of the liquid LQ in the liquid chamber 42 and the nozzle 41 when the volumes of the inflow channel 31 and the outflow channel 51 return from the minimum volumes to the reference volumes.

Figure 21:
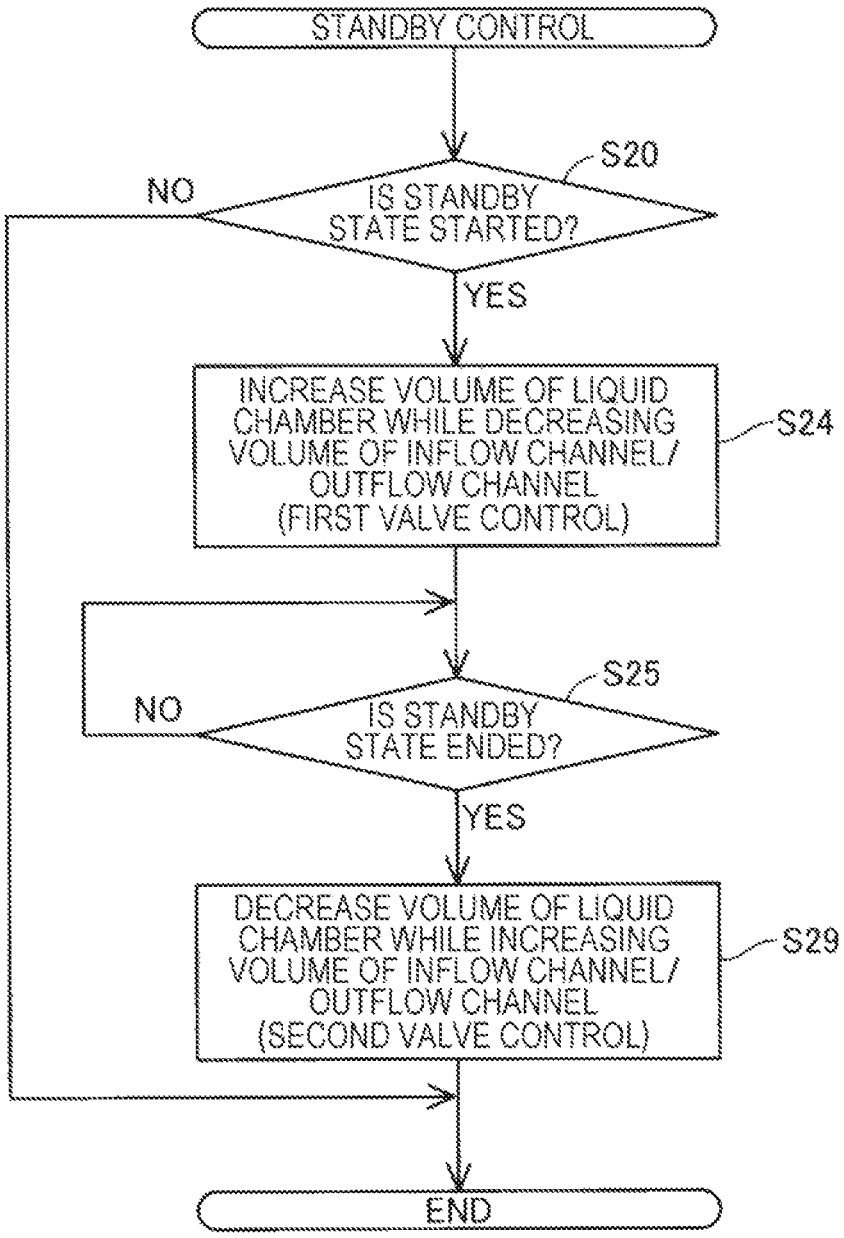
FIG. 21 is a flowchart illustrating flow of standby control of the fourth embodiment.

An example of standby control of the head unit 40D, which is executed by the controller 80, is described with reference to FIG. 21. FIG. 21 is a flowchart illustrating flow of the standby control of the fourth embodiment. The flow of the standby control of the fourth embodiment is the same as the flow (FIG. 12) of the standby control of the second embodiment except that Steps S24 and S29 are provided, instead of Steps S22 and S26.

In Step S24, the controller 80 causes the liquid chamber driving unit 43 to be contracted and deformed so as to increase the volume of the liquid chamber 42 such that the head unit 40D comes into the standby state while causing the driving unit 60 to be elongated and deformed so as to decrease the volumes of the inflow channel 31 and the outflow channel 51 to the minimum volumes. The change amount $\Delta V_R$ of the volume of the liquid chamber 42 in Step S24 is equal to or larger than the movement volume $V_C$ described above. It is desirable that the change amount $\Delta V_R$ of the volume of the liquid chamber 42 in Step S24 is a value smaller than the change amount $\Delta V_R$ in Step S56 in the discharge control described above such that the pressure change does not occur accidentally in the liquid chamber 42. In addition, in Step S24, it is desirable that the outflow channel 51 comes into a substantially blocked state by the emission valve 53.

In the head unit 40D, since the inflow channel 31 and the outflow channel 51 are closed and flowing-in/out of the liquid LQ into or from the liquid chamber 42 is suppressed in a process of Step S24, accident leaking of the liquid LQ from the nozzle 41 is suppressed. In addition, since the volume of the liquid chamber 42 is increased by at least the movement volume $V_C$, leaking of the liquid LQ from the nozzle 41 due to the liquid LQ pushed from the inflow channel 31 and the outflow channel 51 in association with the valve closing operation of the valves 33 and 53 is suppressed.

In Step S29, the controller 80 causes the liquid chamber driving unit 43 to be contracted and deformed so as to decrease the volume of the liquid chamber 42 to the reference volume such that the head unit 40D comes into the standby state while causing the driving unit 60 to be elongated and deformed so as to increase the volumes of the inflow channel 31 and the outflow channel 51 to the reference volumes. Similar to Step S24, the change amount $\Delta V_R$ of the volume of the liquid chamber 42 in Step S29 is a value equal to or larger than the movement volume $V_C$. The change amount $\Delta V_R$ of the volume in Step S29 is the same value as that in Step S27. In Step S29, since the volume of the liquid chamber 42 is decreased by at least the movement volume $V_C$, the suction of the external air from the nozzle 41 in association with the valve opening operation of the valves 33 and 53 is suppressed.

Of the control of the head unit 40D by the controller 80, "first valve control" means control of increasing the volume of the liquid chamber 42 while decreasing the volumes of the inflow channel 31 and the outflow channel 51, such that the change amount $\Delta V_R$ of the volume of the liquid chamber 42 is equal to or larger than the movement volume $V_C$, as described in Steps S56 and S24 (FIGS. 18 and 21). In addition, "second valve control" means control of decreasing the volume of the liquid chamber 42 while increasing the volume of inflow channel 31 and the outflow channel 51, such that the change amount $\Delta V_R$ of the volume of the liquid chamber 42 is equal to or larger than the movement volume $V_C$, as described in Steps S52 and S29 (FIGS. 18 and 21).

According to the liquid discharge apparatus of the fourth embodiment, the first valve control suppresses the leaking of the liquid LQ from the nozzle 41 due to the valve closing operation of the valves 33 and 53. In addition, the second valve control suppresses the entering of the external air from the nozzle 41 to the liquid chamber 42 due to the valve opening operation of the valves 33 and 53. Additionally, according to the liquid discharge apparatus and the method for controlling the liquid discharge apparatus of the fourth embodiment, it is possible to achieve the same types of various operational effects as described in the embodiments.

E. Fifth Embodiment

Figure 22:
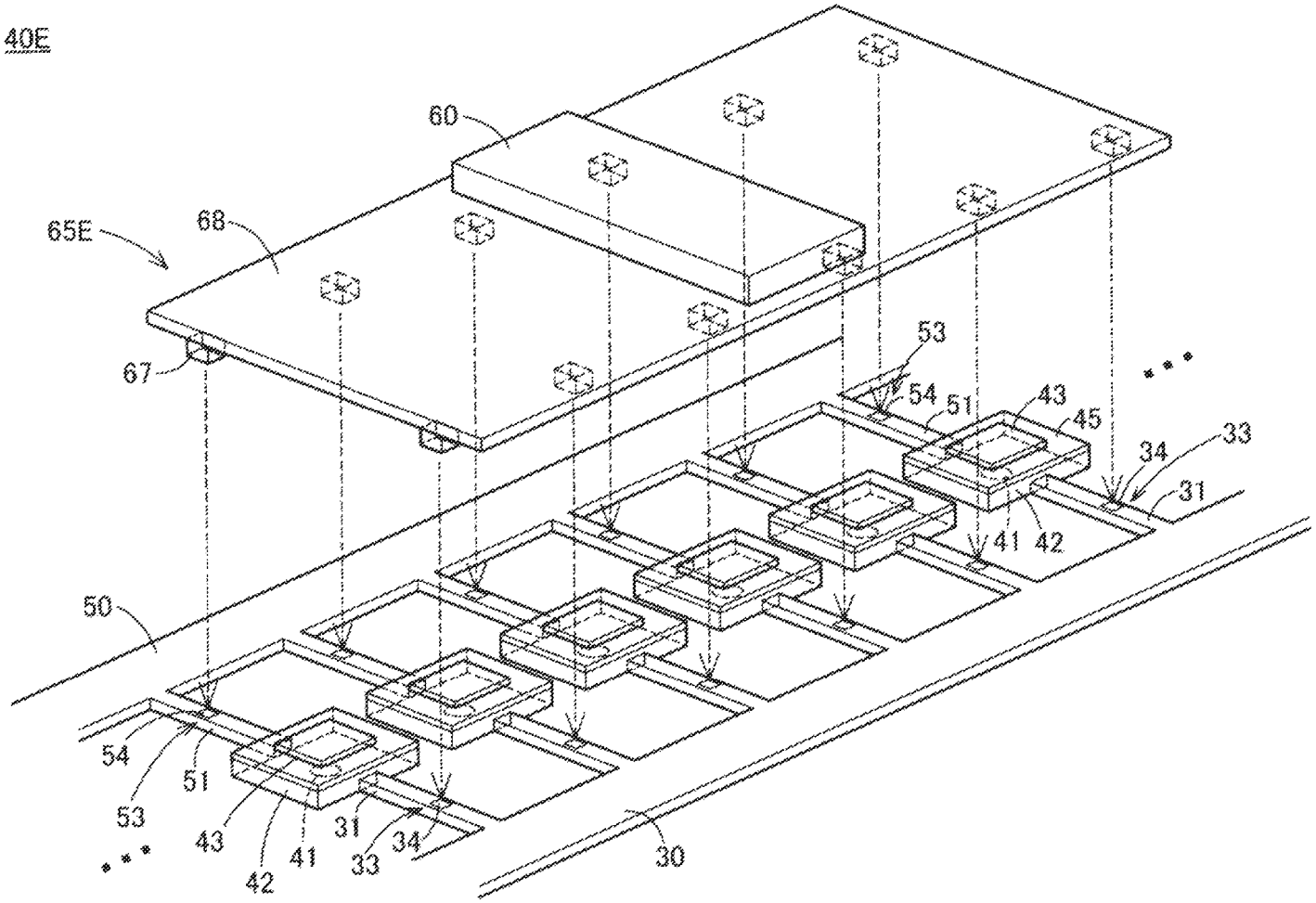
FIG. 22 is a first schematic perspective view illustrating an internal configuration of a head unit in a fifth embodiment.
Figure 23:
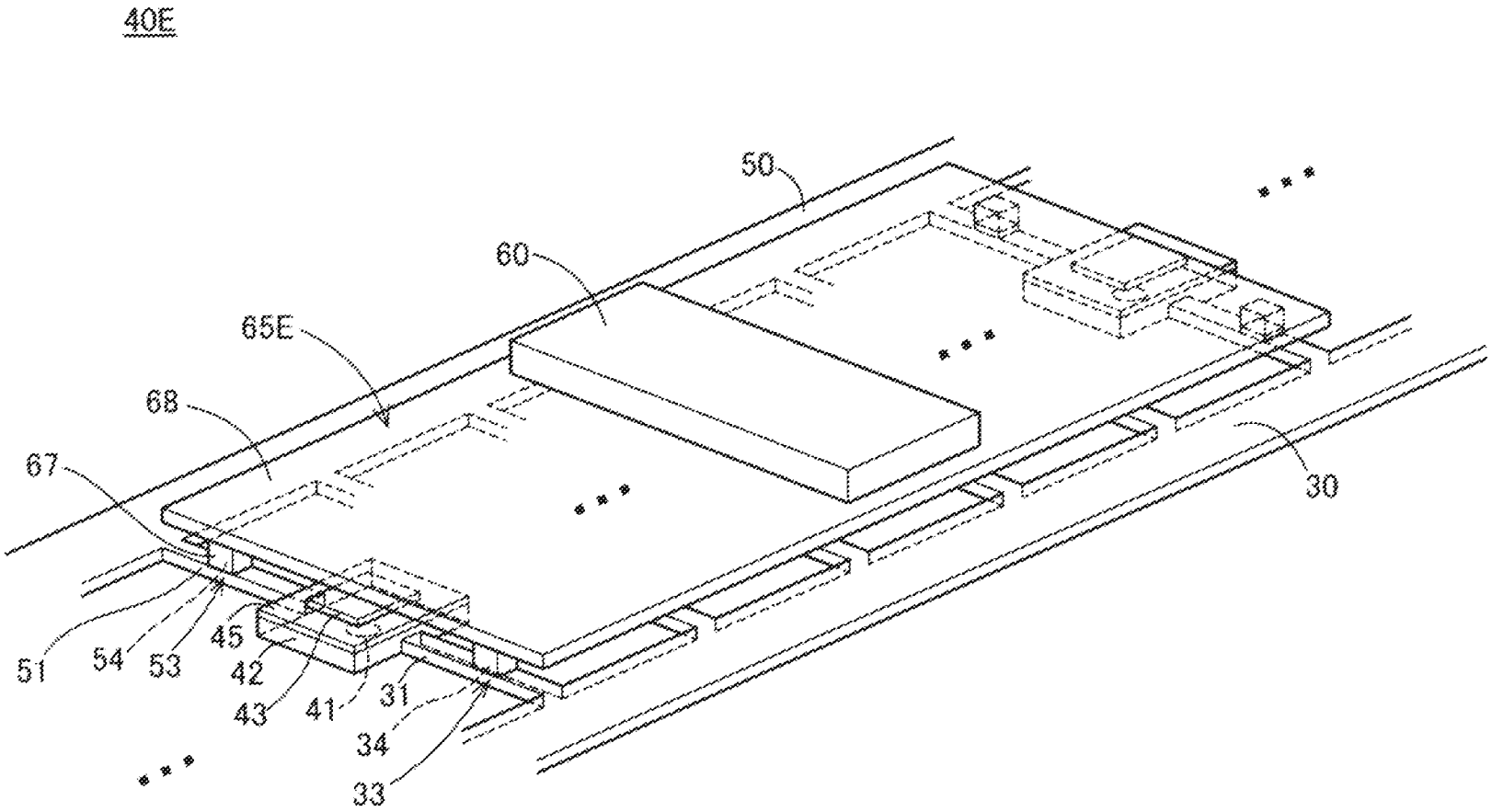
FIG. 23 is a second schematic perspective view illustrating the internal configuration of the head unit in the fifth embodiment.

A configuration of a head unit 40E included in the liquid discharge apparatus of a fifth embodiment is described with reference to FIGS. 22 and 23. FIGS. 22 and 23 illustrate respective schematic perspective views illustrating an internal configuration of the head unit 40E. FIG. 22 is a view illustrating a state in which the connection member 65E is separated for convenience. FIG. 23 illustrates a state of the head unit 40E at the time of use.

The configuration of the liquid discharge apparatus of the fifth embodiment is substantially the same as that of the liquid discharge apparatus 100B (FIG. 7) of the second embodiment, except that the head unit 40E of the fifth embodiment is provided, instead of the head unit 40A. The configuration of the head unit 40E of the fifth embodiment is substantially the same as the configuration (FIGS. 16 and 17) of the head unit 40D of the fourth embodiment, except for a difference to be described below.

The head unit 40E is provided with the nozzle 41 and a plurality of liquid chambers 42 to which the inflow channels 31 and the outflow channels 51 are connected. The inflow channels 31 are provided with the flow channel wall member 34 that configures the supply valve 33, and the outflow channels 51 are provided with the flow channel wall member 54 that configures the emission valve 53. The head unit 40E includes a connection member 65E for transmitting the external force for causing the bending and deformation which is generated by the driving unit 60, to the flow channel wall member 34 and the flow channel wall member 54.

The connection member 65E of the fifth embodiment includes a connection plate 68 provided with a plurality of connection portions 67. The connection plate 68 is configured of a plate-shaped member that covers the flow channel wall member 34 of the supply valve 33 and the flow channel wall member 54 of the emission valve 53, which are provided in the respective liquid chambers 42, and is disposed above the liquid chamber 42 and the liquid chamber driving unit 43. The plurality of connection portions 67 project downward from the lower surface of the connection plate 68 and abut on and are connected to the flow channel wall member 34 of the supply valve 33 and the flow channel wall member 54 of the emission valve 53. The driving unit 60 is disposed on the upper surface of the connection plate 68. The driving unit 60 is elongated/contracted and deformed so as to cause the flow channel wall members 34 and 54 to be bent and deformed due to a vertical shift of the connection member 65E.

In the liquid discharge apparatus of the fifth embodiment, the controller 80 (FIG. 7) executes the same control as the control described in the fourth embodiment, on the head unit 40E. According to the liquid discharge apparatus of the fifth embodiment, it is possible to reduce the head unit 40E in size more than the configuration in which the driving unit 60 is provided for each liquid chamber 42. In addition, the single driving unit 60 can easily synchronize the drive of the plurality of supply valves 33 and the plurality of emission valves 53. Additionally, according to the liquid discharge apparatus of the fifth embodiment, it is possible to achieve the effects by the first valve control and the second valve control described in the fourth embodiment or the same types of various operational effects described in the embodiments.

F. Sixth Embodiment

Figure 24:
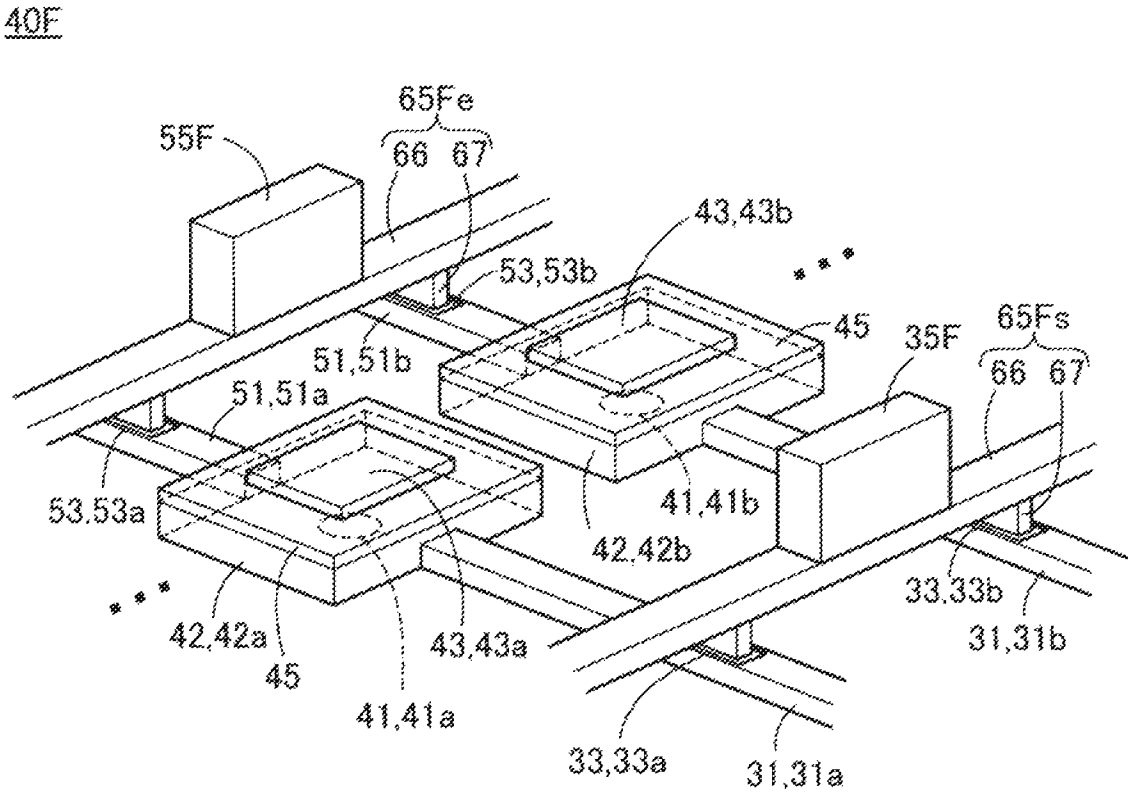
FIG. 24 is a schematic perspective view illustrating an internal configuration of a head unit in a sixth embodiment.

A configuration of a head unit 40F included in the liquid discharge apparatus of a sixth embodiment is described with reference to FIG. 24. FIG. 24 is a schematic perspective view illustrating an internal configuration of the head unit 40F in the sixth embodiment. The configuration of the liquid discharge apparatus of the sixth embodiment is substantially the same as the configuration (FIG. 7) of the liquid discharge apparatus 100B of the second embodiment, except that the head unit 40F of the sixth embodiment is provided, instead of the head unit 40B of the second embodiment. The configuration of the head unit 40F of the sixth embodiment is substantially the same as the configuration (FIG. 13) of the head unit 40C of the third embodiment, except that the plurality of supply valves 33 are configured to be driven by a common driving unit 35F and the plurality of emission valves 53 are configured to be driven by a common driving unit 55F.

The head unit 40F is configured to discharge the liquid LQ from each of the plurality of nozzles 41 including at least both of a first nozzle 41*a* and a second nozzle 41*b*. The head unit 40F includes a plurality of liquid chambers 42 with which the respective nozzles 41 communicate. The plurality of liquid chambers 42 include at least both of a first liquid chamber 42*a* with which the first nozzle 41*a* communicates and a second liquid chamber 42*b* with which the second nozzle 41*b* communicates. The liquid chamber 42 is provided with the liquid chamber driving unit 43. A plurality of liquid chamber driving units 43 included in the head unit 40F include a first liquid chamber driving unit 43*a* that changes the volume of the first liquid chamber 42*a* and a second liquid chamber driving unit 43*b* that changes the volume of the second liquid chamber 42*b*.

The inflow channels 31 provided with the supply valve 33 and the outflow channels 51 provided with the emission valve 53 are connected to the liquid chambers 42, one by one. The plurality of inflow channels 31 included in the head unit 40F include at least both of a first inflow channel 31*a* that is connected to the first liquid chamber 42*a* and a second inflow channel 31*b* that is connected to the second liquid chamber 42*b*. The plurality of outflow channels 51 included in the head unit 40F include at least both of a first outflow channel 51*a* that is connected to the first liquid chamber 42*a* and a second outflow channel 51*b* that is connected to the second liquid chamber 42*b*. A plurality of supply valves 33 included in the head unit 40F include at least both a first supply valve 33*a* that changes the volume of the first inflow channel 31*a* and a second supply valve 33*b* that changes the volume of the second inflow channel 31*b*. A plurality of emission valves 53 included in the head unit 40F include at least both a first emission valve 53*a* that changes the volume of the first outflow channel 51*a* and a second emission valve 53*b* that changes the volume of the second outflow channel 51*b*.

In the head unit 40F, the supply valves 33 including the first supply valve 33*a* and the second supply valve 33*b* changes the volume of the inflow channels 31 including the first inflow channel 31*a* and the second inflow channel 31*b* by the drive force generated by the common driving unit 35F. Hereinafter, the driving unit 35F is referred to as a "supply-side common driving unit 35F". The supply-side common driving unit 35F is configured of a piezoelectric actuator that is expandable and contractible in the vertical direction. The supply-side common driving unit 35F applies the external force generated by the expansion/contraction motion in the vertical direction, as the drive force for changing the volume of the inflow channel 31.

The supply-side common driving unit 35F applies the external force to the flow channel wall members 34 via the connection member 65Fs. The connection member 65Fs includes the bridge portion 66 and a plurality of connection portions 67. The bridge portion 66 is configured as a column-shaped portion which straddles over the flow channel wall members 34. Each of the plurality of connection portions 67 is configured as a projecting portion that projects from the bridge portion 66 toward each of the lower flow channel wall members 34 and abuts on and is connected to each of the flow channel wall members 34. The supply-side common driving unit 35F performs the expansion/contraction motion, and thereby the connection member 65Fs is vertically shifted, and the flow channel wall members 34 are bent and deformed.

In the head unit 40F, the emission valves 53 including the first emission valve 53*a* and the second emission valve 53*b* changes the volume of the outflow channels 51 including the first outflow channel 51*a* and the second outflow channel 51*b* by the drive force generated by the common driving unit 55F. Hereinafter, the driving unit 35F is referred to as an "emission-side common driving unit 55F". The emission-side common driving unit 55F is configured of a piezoelectric actuator that is expandable and contractible in the vertical direction. The emission-side common driving unit 55F applies the external force generated by the expansion/contraction motion in the vertical direction, as the drive force for changing the volume of the outflow channel 51.

The emission-side common driving unit 55F applies the external force to the flow channel wall members 54 via the connection member 65Fe. The connection member 65Fe has the same configuration as that of the connection member 65Fs that is disposed on the side of the inflow channel 31 and includes the bridge portion 66 and the plurality of connection portion 67. The emission-side common driving unit 55F performs the expansion/contraction motion, and thereby the connection member 65Fe is vertically shifted, and the flow channel wall members 54 that are connected to the connection member 65Fe via the connection portion 67 are bent and deformed.

In the liquid discharge apparatus of the sixth embodiment, the controller 80 (FIG. 7) executes the same control as the control described in the third embodiment, on the head unit 40F. According to the liquid discharge apparatus of the sixth embodiment, it is possible to reduce the head unit 40F in size more than the size in the configuration of the third embodiment in which the driving unit 35 is provided for each inflow channel 31, and the driving unit 55 is provided for each outflow channel 51. In addition, the common driving units 35 and 55F can easily synchronize the driving of the supply valve 33 and can easily synchronize the drive of the emission valves 53. In addition, according to the liquid discharge apparatus of the sixth embodiment, similar to the liquid discharge apparatus of the third embodiment, it is possible to separately operate the supply valve 33 and the emission valve 53. Additionally, according to the liquid discharge apparatus of the sixth embodiment, it is possible to achieve the effects by the first supply valve control and the second supply valve control described in the embodiments or the same types of various operational effects described in the embodiments, in addition to the effects by the second emission valve control and the second emission valve control.

G. Seventh Embodiment

Figure 25:
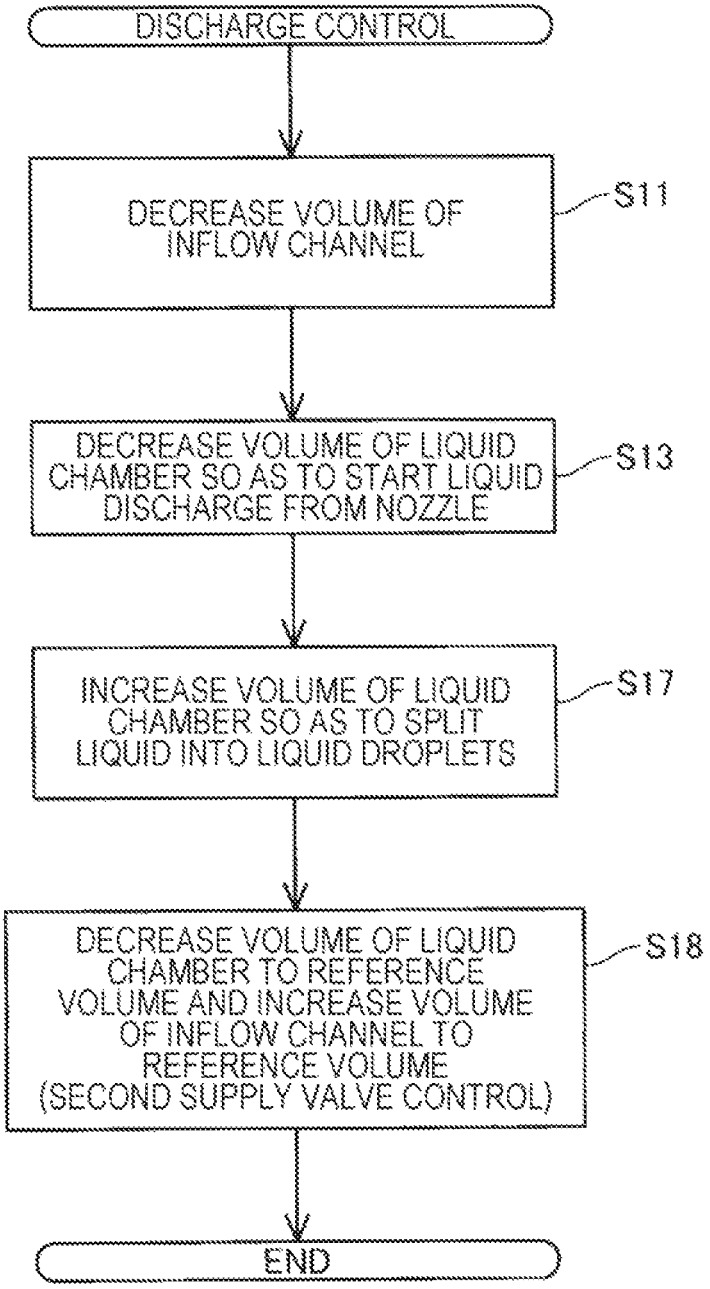
FIG. 25 is a flowchart schematically illustrating flow of discharge control of a seventh embodiment.
Figure 26A:
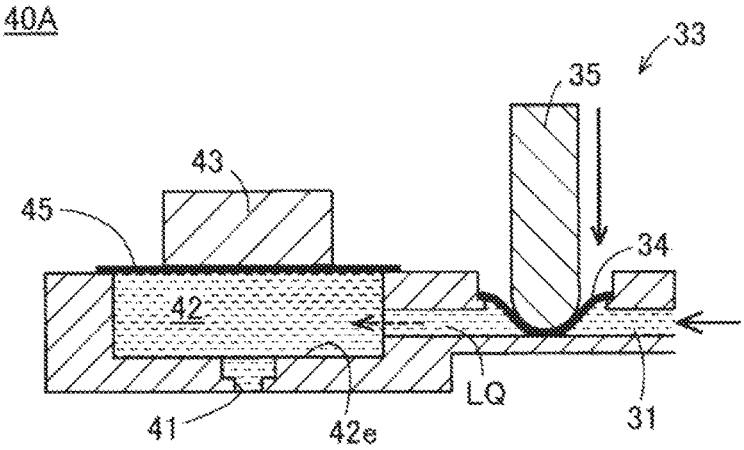
FIG. 26A is a first schematic view illustrating an operation of a head unit in discharge control.
Figure 26B:
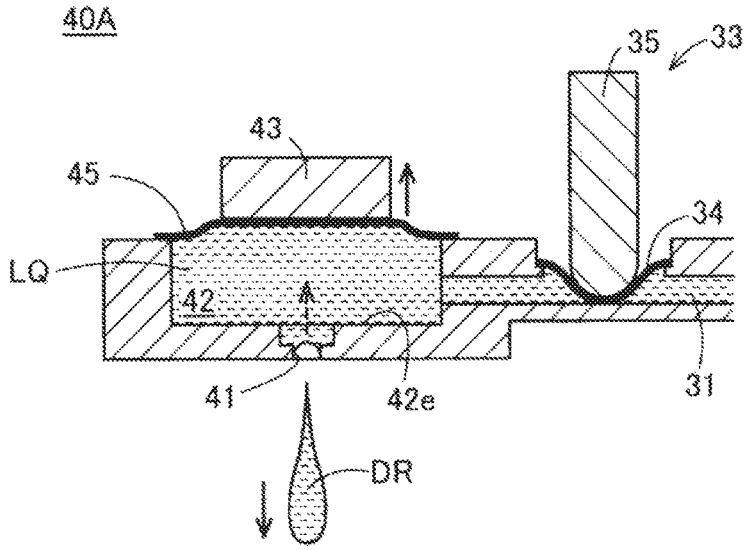
FIG. 26B is a second schematic view illustrating the operation of the head unit in the discharge control.
Figure 26C:
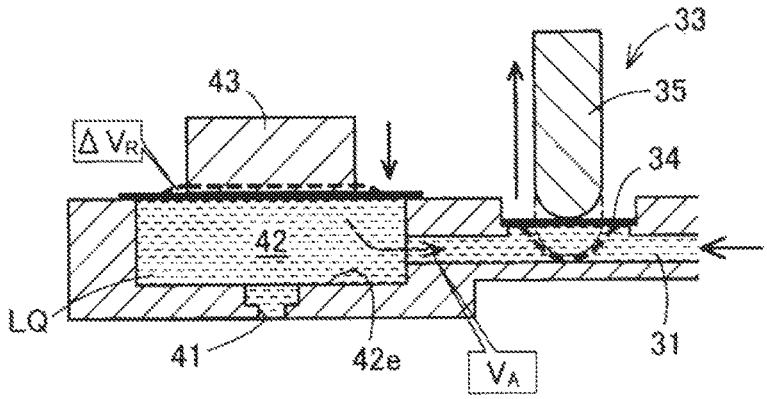
FIG. 26C is a third schematic view illustrating the operation of the head unit in the discharge control.

Discharge control of a seventh embodiment is described with reference to FIG. 25 and FIGS. 26A, 4B, 26B, and 26C in this order. FIG. 25 is a flowchart illustrating flow of the discharge control of the seventh embodiment. FIGS. 26A to 26C are schematic views illustrating an operation of a head unit in a discharge head. FIG. 4B is a view referred to in the first embodiment.

The discharge control of the seventh embodiment is executed in the liquid discharge apparatus 100A (illustrated in FIGS. 1 and 2) described in the first embodiment. The discharge control of the seventh embodiment (FIG. 25) differs from the discharge control of the first embodiment (FIG. 3) in that Steps S11 and S17 are executed, instead of Steps S10 and S16 and, finally, Step S18 of executing the second supply valve control is executed.

Step S11 is a step for preparing a start of discharge of the liquid LQ from the nozzle 41. In Step S11, the controller 80 causes the supply valve 33 to execute a valve closing operation. The controller 80 causes the driving unit 35 to extend so as to decrease the volume of the inflow channel 31 (FIG. 26A). The controller 80 decreases the volume of the inflow channel 31 to a predetermined minimum volume. The minimum volume may be a volume obtained by blocking the inflow channel 31 described in the first embodiment.

The controller 80 preferably adjusts the pressure of the liquid chamber 42 such that the internal pressure of the liquid chamber 42, which is obtained after the volume of the inflow channel 31 is decreased in Step S11, is equal to or lower than the meniscus pressure resistance of the nozzle 41, before execution of Step S11. In this manner, the flow of the liquid LQ is suppressed from the nozzle 41 when the volume of the inflow channel 31 is decreased.

Similar to the description in the first embodiment, in Step S13, the controller 80 drives the liquid chamber driving unit 43 so as to decrease the volume of the liquid chamber 42 and starts the discharge of the liquid LQ from the nozzle 41 (FIG. 4B). At this time, in Step S11, since the flow-channel resistance of the inflow channel 31 is increased, a loss of the pressure generated in the liquid chamber 42 in order to discharge the liquid LQ, to the inflow channel 31, is suppressed.

Step S17 is a step of splitting the liquid LQ discharged from the nozzle 41 into liquid droplets DR. In Step S17, the controller 80 contracts the liquid chamber driving unit 43 during the discharge of the liquid LQ from the nozzle 41 so as to increase the volume of the liquid chamber 42, thereby reducing the pressure of the liquid chamber 42 (FIG. 26B). In this manner, a suction force of suctioning the liquid LQ back to the liquid chamber 42 from the nozzle 41 is generated, and thus the liquid LQ discharged out from the nozzle 41 can be separated from the liquid LQ in the nozzle 41 so as to fly as the liquid droplets DR.

In Step S17, the controller 80 increases the volume of the liquid chamber 42 more than the reference volume. In this manner, it is possible to generate higher negative pressure in the liquid chamber 42, and it is possible to reliably split the liquid LQ of the nozzle 41 into the liquid droplets DR. Accordingly, a flying state of the liquid droplets DR improves.

In Step S17, the volume of the inflow channel 31 remains to be smaller than the reference volume by the supply valve 33, and a state in which the flow-channel resistance of the inflow channel 31 is large is maintained. Therefore, the supply of the liquid LQ from the inflow channel 31 suppresses a reduction in the negative pressure generated in the liquid chamber 42.

In Step S18, the controller 80 executes the second supply valve control. The controller 80 increases the volume of the inflow channel 31 to the reference volume while decreasing the volume of the liquid chamber 42 to the reference volume (FIG. 26C). At this time, a change amount $\Delta V_R$ of the volume of the liquid chamber 42 is equal to or larger than the volume $V_A$ of the liquid LQ flowing from the liquid chamber 42 out to the inflow channel 31 due to a valve opening operation of the supply valve 33 which increases the volume of the inflow channel 31. In this manner, the liquid LQ flows out to the inflow channel 31 due to the valve opening operation of the supply valve 33, and the generation of the negative pressure by suctioning external air into the liquid chamber 42 from the nozzle 41 is suppressed.

As described above, according to the discharge control of the seventh embodiment, the second supply valve control after the discharge of the liquid LQ suppresses entering of the external air into the liquid chamber 42 through the nozzle 41. Additionally, according to the liquid discharge apparatus 100A in the seventh embodiment, it is possible to achieve various types of operation effects described in the embodiments described above, in addition to various types of operation effects described in the seventh embodiment.

H. Another Embodiment

For example, it is also possible to modify various types of configurations described in the embodiments described above into the following configurations. Similar to the embodiments described above, any one of the configurations of the other embodiments to be described below is also placed as an example of an embodiment of the invention.

H1. Another Embodiment 1:

In the embodiments (except for the second embodiment) described above, the supply valve 33 changes the volume of the inflow channel 31 by causing the flow channel wall member 34 configured as a part of the inner wall surface of the inflow channel 31 to be bent and deformed. By comparison, the supply valve 33 may change the volume of the inflow channel 31 by employing another configuration. For example, the supply valve 33 may be configured of a shutter wall portion that is shifted across the inflow channel 31 and changes a sectional area of the inflow channel 31. Also in this configuration, the volume of the inflow channel 31 is changed by an amount of the shift of the shutter wall portion. In addition, the supply valve 33 may cause the entire inner wall surface of the inflow channel 31 to be deformed so as to change the volume of the inflow channel 31.

H2. Another Embodiment 2:

In the embodiments (except for the first embodiment and the seventh embodiment) described above, the emission valve 53 changes the volume of the outflow channel 51 by causing the flow channel wall member 54 configured as a part of the inner wall surface of the outflow channel 51 to be bent and deformed. By comparison, the emission valve 53 may change the volume of the outflow channel 51 by employing another configuration. For example, the emission valve 53 may be configured of a shutter wall portion that is shifted across the outflow channel 51 and changes a sectional area of the outflow channel 51. Also in this configuration, the volume of the outflow channel 51 is changed by an amount of the shift of the shutter wall portion. In addition, the emission valve 53 may cause the entire inner wall surface of the outflow channel 51 to be deformed so as to change the volume of the outflow channel 51.

H3. Another Embodiment 3:

In the embodiments described above, the driving unit 35, 55, or 60 is configured of the piezoelectric actuator. By comparison, the driving unit 35, 55, or 60 may be configured of an actuator other than the piezoelectric actuator. For example, the driving unit 35, 55, or 60 may be configured of another actuator such as an air cylinder, a solenoid, or a megnetostrictor.

H4. Another Embodiment 4:

In the embodiments described above, the liquid chamber driving unit 43 is configured of the piezoelectric actuator. By comparison, the liquid chamber driving unit 43 may be configured of an actuator other than the piezoelectric actuator. The liquid chamber driving unit 43 may be configured of another actuator such as an air cylinder, a solenoid, or a magnetostrictor.

H5. Another Embodiment 5:

The control of the head units 40A to 40E by the controller 80 described in the embodiments described above is only an example, and the details of the control by the controller 80 are not limited to the control described in the embodiments described above. For example, in the third embodiment described above, the discharge control (FIGS. 18 and 19) or the standby control (FIG. 21) described in the fourth embodiment may be executed. In the first embodiment and the third embodiment described above, one of the first supply valve control and the second supply valve control may not be executed. In addition, the first supply valve control and the second supply valve control may be executed in control other than the discharge control or the standby control. Similarly, in the second embodiment and the third embodiment described above, one of the first emission valve control and the second emission valve control may not be executed. In addition, the first emission valve control and the second emission valve control may be executed in control other than the discharge control or the standby control. In the fourth embodiment and the fifth embodiment described above, one of the first valve control and the second valve control may not be executed. In addition, the first valve control and the second valve control may be executed in control other than the discharge control or the standby control. The first valve control or the second valve control may be configured to be executed only in the standby control. In this case, in the fourth embodiment and the fifth embodiment, the following discharge control may be executed. While the volume of the inflow channel 31 and the supply valve 33 is decreased from the reference volume to the minimum volume, the liquid chamber driving unit 43 rapidly decreases the volume of the liquid chamber 42 such that the liquid is discharged from the nozzle 41. While the volume of the liquid chamber 42 is increased to return to the reference volume, the volumes of the inflow channel 31 and the supply valve 33 are increased to return to the reference volume.

H6. Another Embodiment 6:

In the first supply valve control and the second supply valve control described in the embodiments described above, a period, during which the supply valve 33 is driven, and a period, during which the liquid chamber driving unit 43 is driven, may not be coincident with each other or may not overlap each other. In other words, in the first supply valve control and the second supply valve control, the operation of changing the volume of the liquid chamber 42 by the liquid chamber driving unit 43 may be executed in association with the operation of changing the volume of the inflow channel 31 by the supply valve 33. Here, "to execute in association with" means "to be interlocked and executed". In the first supply valve control and the second supply valve control, a start and an end of a drive period of the supply valve 33 and a start and an end of a drive period of the liquid chamber driving unit 43 may be appropriately adjusted and set in consideration of a period of time in which the liquid LQ moves between the inflow channel 31 and the liquid chamber 42. The same is true of a start and an end of a drive period of the emission valve 53 and a start and an end of a drive period of the liquid chamber driving unit 43 in the first emission valve control and the second emission valve control. In addition, the same is true of a start and an end of a drive period of the supply valve 33, a start and an end of a drive period of the emission valve 53, a start and an end of a drive period of the liquid chamber driving unit 43 in the first valve control and the second valve control. According to the interpretation of the expression of "in association with", the first supply valve control of increasing the volume of the liquid chamber 42 in association with the decrease in volume of the inflow channel 31 includes a control state of alternately repeating operations of a slight decrease in volume of the inflow channel 31 and, then, a slight increase in volume of the liquid chamber 42. In addition, the second supply valve control of decreasing the volume of the liquid chamber 42 in association with the increase in volume of the inflow channel 31 includes a control state of alternately repeating the operations of the slight increase in volume of the inflow channel 31 and, then, the slight decrease in volume of the liquid chamber 42. Similarly, the first emission valve control of increasing the volume of the liquid chamber 42 in association with the decrease in volume of the outflow channel 51 includes a control state of alternately repeating operations of the slight decrease in volume of the outflow channel 51 and, then, the slight increase in volume of the liquid chamber 42. In addition, the second emission valve control of decreasing the volume of the liquid chamber 42 in association with the increase in the volume of the outflow channel 51 includes a control state of alternately repeating the operations of the slight increase in volume of the outflow channel 51 and, then, the slight decrease in volume of the liquid chamber 42.

H7. Another Embodiment 7:

The liquid discharge apparatus 100A of the first embodiment may employ a configuration of including the outflow channel 51 that is connected to the liquid chamber 42 as described from the second embodiment.

H8. Another Embodiment 8:

In the sixth embodiment described above, similar to the head unit 40C of the third embodiment, a configuration in which only the emission valve 53 is driven by the emission-side common driving unit 55F and the supply valve 33 is driven by the driving unit 35 provided in the supply valve 33 may be employed. Conversely, similar to the head unit 40C of the third embodiment, a configuration in which only the supply valve 33 is driven by the supply-side common driving unit 35F and the emission valve 53 is driven by the driving unit 55 provided for each emission valve 53 may be employed.

H9. Another Embodiment 9:

In the embodiment described above, the plurality of inflow channels 31 or the plurality of outflow channels 51 may include a channel that is not provided with the supply valve 33 or the emission valve 53. In addition, in a case where the head unit 40D of the fourth embodiment described above has a configuration in which the liquid LQ is discharged from the plurality of nozzles 41, a configuration in which the supply valve 33 and the emission valve 53 are driven by different driving units may be included. Also in the head unit 40E of the fifth embodiment, a plurality of sets of the supply valves 33 and the emission valves 53 may include a valve that is driven by a driving unit different from the common driving unit 60. Also in the head unit 40F of the sixth embodiment, the plurality of supply valves 33 may include a supply valve 33 that is driven by a driving unit different from the supply-side common driving unit 35F, and the plurality of emission valves 53 may include an emission valve 53 that is driven by a driving unit different from the emission-side common driving unit 55F.

H10. Another Embodiment 10:

The invention is not limited to the liquid discharge apparatus that discharges ink and can be applied to any liquid discharge apparatus that discharges a liquid other than the ink. For example, the invention can be applied to the following various types of liquid discharge apparatuses.

(1) An Image recording apparatus such as a facsimile apparatus (2) A color material discharge apparatus that is used for manufacturing a color filter for an image display apparatus such as a liquid crystal display (3) An electrode material discharge apparatus that is used for forming an electrode such as organic electro luminescence (EL) display or a field emission display (FED) or the like (4) A liquid discharge apparatus that discharges the liquid including a bioorganic material that is used for manufacturing a biochip (5) A sample discharge apparatus as accurate pipette (6) A discharge apparatus of a lubricant (7) A discharge apparatus of a resin liquid (8) A liquid discharge apparatus that discharges a lubricant by pinpointing with precision instrument such as a watch or a camera (9) A liquid discharge apparatus that discharges a transparent resin liquid such as a UV curable resin liquid on a substrate in order to form a micro hemispherical lens (optical lens) which is used in an optical communication element

(10) A liquid discharge apparatus that discharges an acidic or alkaline etchant in order to etch a substrate or the like

(11) A liquid discharge apparatus including a liquid discharge head that discharges another type of any small amount of liquid droplets H11. Another Embodiment 11:

According to the embodiments described above, some or all of functions and processes realized by software may be realized by hardware. In addition, some or all of functions and processes realized by hardware may be realized by software. For example, it is possible to use, as hardware, various types of circuits such as an integrated circuit, a discrete circuit, or a circuit module in which the circuits are combined.

The invention is not limited to the embodiments, examples, or modification examples described above, and it is possible to realize the invention with various configurations within a range without departing from a gist thereof. For example, it is possible to appropriately replace or combine technical features described in the embodiments, examples, and modification examples, which correspond to technical features in the example described in Summary, in order to solve some or all of the problems described above or in order to achieve some or all of the effects described above. In addition, appropriate removal is not limited to the technical features that are described to be unessential in the specification, it is possible to appropriately remove the technical features that are not described to be essential.

The "inflow channel 31" and the "outflow channel 51" in the embodiments described above correspond to a subordinate concept of the "flow channel". The "supply valve 33" and the "emission valve 53" correspond to a subordinate concept of the "valve". The "first supply valve control", the "first emission valve control", and the "first valve control" each correspond to a subordinate concept of the "first control" of causing the liquid chamber driving unit to increase the volume of the liquid chamber in association with the decrease in volume of the flow channel by the valve such that a change amount of the volume of the liquid chamber is equal to or larger than the volume of the liquid flowing from the flow channel into the liquid chamber while the volume of the flow channel is changed. The "second supply valve control", the "second emission valve control", and the "second valve control" each correspond to a subordinate concept of the "second control" of causing the liquid chamber driving unit to decrease the volume of the liquid chamber in association with the increase in volume of the flow channel by the valve such that a change amount of the volume of the liquid chamber is equal to or larger than the volume of the liquid flowing from the liquid chamber out to the flow channel while the volume of the flow channel is changed.

In the specification, the "liquid" may be a material that can be consumed by the liquid discharge apparatus. For example, the "liquid" may be a material in a state obtained when a substance is in a liquid phase, and the "liquid" includes a liquid-state material having high or low viscosity and a liquid-state material such as a sol, gel water, another inorganic solvent, an organic solvent, a solution, liquid resin, or liquid metal (metallic melt). In addition, the "liquid" includes not only a liquid having a substance state, but also a substance obtained by dissolving, dispersing, or mixing, in a solvent, particles of a functional material from a solid matter such as pigment or metal particles. Representative examples of the liquid include ink, liquid crystal, or the like. Here, the ink includes various types of liquid compositions such as general aqueous ink, oil ink, gel ink, or hot-melt ink. In addition, the "liquid droplet" means a state of the liquid that is discharged from the liquid discharge apparatus and includes a grain-shaped droplet, a teardrop-like droplet, and a droplet having a thread-like tail.

The entire disclosures of Japanese Patent Application No. 2017-253336, filed Dec. 28, 2017 and No. 2017-062701, filed Mar. 28, 2017 are expressly incorporated by reference herein.

What is claimed is:

1. A liquid discharge apparatus comprising:

a liquid chamber that communicates with a nozzle and contains a liquid;

a liquid chamber driving unit that changes a volume of the liquid chamber so as to discharge the liquid from the nozzle;

a flow channel which is connected to the liquid chamber, the flow channel including an inflow channel through which the liquid supplied to the liquid chamber flows;

a valve that changes flow-channel resistance of the flow channel so as to control flow of the liquid between the liquid chamber and the flow channel, the valve including a supply valve that is provided in the inflow channel that is configured to shift an inner surface of the flow channel so as to change a volume of the inflow channel; and a controller that controls the liquid chamber driving unit and the valve, wherein the controller executes at least one of (i) first supply valve control of causing the liquid chamber driving unit to increase the volume of the liquid chamber in association with a decrease in volume of the inflow channel by the supply valve, such that a change amount of the volume of the liquid chamber is equal to or larger than a volume of the liquid flowing from the inflow channel into the liquid chamber due to the decrease in volume of the inflow channel, and (ii) second supply valve control of causing the liquid chamber driving unit to decrease the volume of the liquid chamber in association with an increase in volume of the inflow channel by the supply valve, such that a change amount of the volume of the liquid chamber is equal to or larger than a volume of the liquid flowing from the liquid chamber out to the inflow channel due to the increase in volume of the inflow channel.

2. The liquid discharge apparatus according claim 1, wherein the liquid chamber includes a first liquid chamber communicating with a first nozzle and a second liquid chamber communicating with a second nozzle, wherein the liquid chamber driving unit includes a first liquid chamber driving unit that changes a volume of the first liquid chamber and a second liquid chamber driving unit that changes a volume of the second liquid chamber, wherein the inflow channel includes a first inflow channel connected to the first liquid chamber and a second inflow channel connected to the second liquid chamber, wherein the supply valve includes a first supply valve that changes a volume of the first inflow channel and a second supply valve that changes a volume of the second inflow channel, wherein the controller causes, in the first control and the second control, the second liquid chamber driving unit to change the volume of the second liquid chamber while causing the first liquid chamber driving unit to change the volume of the first liquid chamber, in association with the change in volume of the second inflow channel by the second supply valve while causing the first supply valve to change the volume of the first inflow channel, and wherein the first supply valve and the second supply valve change the volumes of the first inflow channel and the second inflow channel with a drive force generated by a common drive unit.

3. A liquid discharge apparatus comprising:

a liquid chamber that communicates with a nozzle and contains a liquid;

a liquid chamber driving unit that changes the volume of the liquid chamber so as to discharge the liquid from the nozzle;

a flow channel which is connected to the liquid chamber, the flow channel including the inflow channel through which the liquid supplied to the liquid chambers flows and an outflow channel through which the liquid is emitted from the liquid chamber flows;

a valve that changes flow-channel resistance of the flow channel so as to control flow liquid between the liquid chamber and the flow channel, valve including an emission valve that is configured to the shift an inner wall surface of the outflow channel so as to change a volume of the outflow channel; and a controller that controls the liquid chamber driving unit and the valve, wherein the controller executes at least one of first emission valve control of causing the liquid chamber driving unit to increase the volume of the liquid chamber in association with a decrease in volume of the outflow channel by the emission valve, such that a change amount of the volume of the liquid chamber is equal to or larger than a volume of the liquid flowing from the outflow channel into the liquid chamber due to the decrease in volume of the outflow channel, and second emission valve control of causing the liquid chamber driving unit to decrease the volume of the liquid chamber in association with an increase in volume of the outflow channel by the emission valve, such that a change amount of the volume of the liquid chamber is equal to or larger than the volume of the liquid flowing from the outflow channel into the liquid chamber due to the increase in volume of the outflow channel.

4. The liquid discharge apparatus according to claim 3, wherein the liquid chamber includes a first liquid chamber communicating with a first nozzle and a second liquid chamber communicating with a second nozzle, wherein the liquid chamber driving unit includes a first liquid chamber driving unit that changes a volume of the first liquid chamber and a second liquid chamber driving unit that changes a volume of the second liquid chamber, wherein the inflow channel includes a first inflow channel connected to the first liquid chamber and a second inflow channel connected to the second liquid chamber, wherein the outflow channel includes a first outflow channel connected to the first liquid chamber and a second outflow channel connected to the second liquid chamber, wherein the emission valve includes a first emission valve that changes a volume of the first outflow channel and a second emission valve that changes a volume of the second outflow channel, wherein the controller causes, in the first control and the second control, the second liquid chamber driving unit to change the volume of the second liquid chamber while causing the first liquid chamber driving unit to change the volume of the first liquid chamber, in association with the change in volume of the second outflow channel by the second emission valve while causing the first emission valve to change the volume of the first outflow channel, and wherein the first emission valve and the second emission valve change the volumes of the first outflow channel and the second outflow channel with a drive force generated by a common drive unit.

5. The liquid discharge apparatus according to claim 3, further comprising:

a circulation channel for circulating, to the inflow channel, the liquid emitted to the outflow channel.

6. A liquid discharge apparatus comprising:

a liquid chamber that communicates with a nozzle and contains a liquid;

a liquid chamber driving unit that changes a volume of the liquid chambers so as to discharge the liquid from the nozzle;

a flow channel which is connected to the liquid chamber, the flow channel including an inflow channel through which the liquid supplied to the liquid chamber flows and an outflow channel through which the liquid emitted from the liquid chamber flows;

a valve that changes flow-channel resistance of the flow channel so as to control flow of the liquid between the liquid chamber and the flow channel, the valve including a supply valve that shifts an inner wall surface of the inflow channel so as to change a volume of the inflow channel and an emission valve that shifts the inner wall surface of the outflow channel so as to change a volume of the outflow channel; and a controller that controls the liquid chamber driving unit and the valve, wherein the controller executes at least one of first valve control of causing the liquid chamber driving unit to increase the volume of the liquid chamber, in association with a decrease in volume of the outflow channel by the emission valve while causing the supply valve to decrease the volume of the inflow channel, such that a change amount of the volume of the liquid chamber is equal to or larger than a volume of the liquid flowing from the inflow channel and the outflow channel into the liquid chamber due to the decrease in both of the volume of the inflow channel and the volume of the outflow channel, and second valve control of causing the liquid chamber driving unit to decrease the volume of the liquid chamber in association with an increase in volume of the outflow channel by the emission valve while causing the supply valve to increase the volume of the inflow channel, such that a change amount of the volume of the liquid chamber is equal to or larger than the volume of the liquid flowing from the inflow channel and the outflow channel into the liquid chamber due to the increase in both of the volume of the inflow channel and the volume of the outflow channel.

7. The liquid discharge apparatus according to claim 6, wherein the supply valve and the emission valve change the volume of the outflow channel and the volume of the inflow channel with a drive force generated by a common drive unit.

8. A method for controlling a liquid discharge apparatus that includes:

a liquid chamber that communicates with a nozzle and contains a liquid;

a liquid chamber driving unit that changes a volume of the liquid chamber so as to discharge the liquid from the nozzle;

a flow channel which is connected to the liquid chamber, the flow channel including an inflow channel though which the liquid supplied to the liquid chamber flows;

a valve that changes flow-channel resistance of the flow channel so as to control flow of the liquid between the liquid chamber and the flow channel, the valve including a supply valve that is provided in the inflow channel and that is configured to shift an inner surface of the flow channel so as to change a volume of the inflow channel; and a controller that controls the liquid chamber driving unit and valve, the method comprising: executing the controller so as to perform at least one of (i) first supply valve control of causing the liquid chamber driving unit to increase the volume of the liquid chamber in association with a decrease in volume of the inflow channel by the supply valve, such that a change amount of the volume of the liquid chamber is equal to or larger than a volume of the liquid flowing from the inflow channel into the liquid chamber due to a decrease in volume of the inflow channel, and (ii) second supply valve control of causing the liquid chamber driving unit to decrease the volume of the liquid chamber in association with an increase in volume of the inflow channel by the supply valve, such that a change amount of the volume of the liquid chamber is equal to or larger than a volume of the liquid flowing from the liquid chamber out to the inflow channel due to the increase in volume of the inflow channel.

* * * * *